US007370788B1

(12) United States Patent
Otani et al.

(10) Patent No.: US 7,370,788 B1
(45) Date of Patent: May 13, 2008

(54) FORMED BODY

(75) Inventors: Kenichi Otani, Tochigi (JP); Yoshiaki Kumamoto, Tochigi (JP); Koichi Sagara, Tochigi (JP); Shinji Kodama, Tochigi (JP); Minoru Goto, Tochigi (JP); Susumu Fujinami, Tokyo (JP); Tokuo Tsuura, Tochigi (JP); Shinji Otakura, Tochigi (JP); Takehiko Tojo, Tochigi (JP); Yukiya Sato, Wakayama (JP); Masataka Ishikawa, Tochigi (JP); Shingo Odajima, Tochigi (JP); Masanori Takita, Tochigi (JP)

(73) Assignee: Kao Corporation, Tokyo (JP)

( * ) Notice: Subject to any disclaimer, the term of this patent is extended or adjusted under 35 U.S.C. 154(b) by 1140 days.

(21) Appl. No.: 09/868,040

(22) PCT Filed: May 6, 1999

(86) PCT No.: PCT/JP99/02367

§ 371 (c)(1),
(2), (4) Date: Jul. 23, 2001

(87) PCT Pub. No.: WO00/40801

PCT Pub. Date: Jul. 13, 2000

(30) Foreign Application Priority Data

| | | |
|---|---|---|
| Dec. 28, 1998 | (JP) | 10-373713 |
| Dec. 28, 1998 | (JP) | 10-373717 |
| Dec. 28, 1998 | (JP) | 10-373718 |
| Dec. 28, 1998 | (JP) | 10-374351 |
| Dec. 28, 1998 | (JP) | 10-374353 |
| Jan. 29, 1999 | (JP) | 11-021599 |
| Feb. 5, 1999 | (JP) | 11-029290 |

(51) Int. Cl.
*B65D 1/00* (2006.01)

(52) U.S. Cl. ..... 229/406; 229/407

(58) Field of Classification Search ..... 229/406, 229/407

See application file for complete search history.

(56) References Cited

U.S. PATENT DOCUMENTS

| | | | | |
|---|---|---|---|---|
| 1,966,469 | A * | 7/1934 | Taylor | 229/406 X |
| 2,033,855 | A * | 3/1936 | Sloan | 229/406 X |
| 2,042,210 | A * | 5/1936 | Clay | 229/406 X |

(Continued)

FOREIGN PATENT DOCUMENTS

| | | |
|---|---|---|
| EP | 0 562 590 | 9/1993 |

(Continued)

OTHER PUBLICATIONS

Density of Solid Objects, http://dana.ucc.nau.edu/~te/scienceworld/density/Density_files/frame.html.*

(Continued)

*Primary Examiner*—T. Mai
(74) *Attorney, Agent, or Firm*—Oblon, Spivak, McClelland, Maier & Neustadt, P.C.

(57) ABSTRACT

A molded article (10) made predominantly of pulp and comprising a bottom portion (13) and a body portion (12), wherein the angle θ between the outer surface of a side wall of the body portion (12) and the ground contact plane (B) of the bottom portion (13) is 85° or greater, and the height of the body portion (12) is 50 mm or more.

7 Claims, 14 Drawing Sheets

U.S. PATENT DOCUMENTS

| | | | | | |
|---|---|---|---|---|---|
| 2,387,778 | A | * | 10/1945 | Stocking | 229/406 X |
| 2,530,124 | A | * | 11/1950 | Kieckhefer | 229/406 X |
| 2,722,719 | A | * | 11/1955 | Altsadter | 229/406 X |
| 2,738,914 | A | * | 3/1956 | Hatch | 229/406 X |
| 2,961,043 | A | | 11/1960 | Hicks | |
| 3,612,326 | A | | 10/1971 | Marks | |
| 4,058,247 | A | * | 11/1977 | Florian | 229/406 X |
| 4,088,259 | A | | 5/1978 | Sutton | |
| 4,162,759 | A | * | 7/1979 | Reifers et al. | 229/406 X |
| 4,337,116 | A | | 6/1982 | Foster et al. | |
| 4,856,704 | A | * | 8/1989 | Tolson et al. | 229/406 X |
| 5,004,121 | A | * | 4/1991 | Howe | |
| 5,934,472 | A | * | 8/1999 | Ramirez | 229/406 X |

FOREIGN PATENT DOCUMENTS

| | | |
|---|---|---|
| GB | 1348370 | 3/1974 |
| JP | 35-9669 | 7/1960 |
| JP | 46-6640 | 12/1971 |
| JP | 47-25257 | 8/1972 |
| JP | 50-149460 | 5/1974 |
| JP | 51-137571 | 11/1976 |
| JP | 51-139838 | 12/1976 |
| JP | 53-16353 | 5/1978 |
| JP | 53-67783 | 6/1978 |
| JP | 54-133972 | 10/1979 |
| JP | 55-19828 | 5/1980 |
| JP | 56-34452 | 4/1981 |
| JP | 59-96111 | 6/1984 |
| JP | 60-52215 | 4/1985 |
| JP | 61-174500 | 8/1986 |
| JP | 63-282301 | 11/1988 |
| JP | 5-502065 | 4/1993 |
| JP | 5-61052 | 8/1993 |
| JP | 5-279998 | 10/1993 |
| JP | 6-9943 | 3/1994 |
| JP | 7-40959 | 2/1995 |
| JP | 8-34424 | 2/1996 |
| JP | 8-209600 | 8/1996 |
| JP | 8-301288 | 11/1996 |
| JP | 8-302600 | 11/1996 |
| JP | 8-337234 | 12/1996 |
| JP | 9-142445 | 6/1997 |
| JP | 9-255031 | 9/1997 |
| JP | 9-309521 | 12/1997 |
| JP | 10-46500 | 2/1998 |
| JP | 10-131100 | 5/1998 |
| JP | 10-258841 | 9/1998 |
| WO | WO 90/04678 | 5/1990 |

OTHER PUBLICATIONS

UCS Tests and Young's Modulus, http://www.jktech.com.au/LabServices/ucs_tests.htm.*
U.S. Appl. No. 09/898,040, filed Jul. 23, 2001, Kumamoto, et al.
U.S. Appl. No. 10/365,453, filed Feb. 13, 2003, Kumamoto, et al.
U.S. Appl. No. 09/508,540, filed Apr. 7, 2000, Otsuji et al.
U.S. Appl. No. 09/868,040, filed Jul. 23, 2001, Otani et al.
U.S. Appl. No. 10/182,743, filed Aug. 15, 2002, Nonomura et al.
U.S. Appl. No. 10/212,723, filed Aug. 7, 2002, Kumamoto et al.
U.S. Appl. No. 10/204,859, filed Aug. 26, 2002, Otani et al.
U.S. Appl. No. 10/335,153, filed Jan. 2, 2003, Kumamoto et al.

* cited by examiner

FORMED BODY

TECHNICAL FIELD

The present invention relates to a molded article comprising pulp as a major component.

BACKGROUND ART

Plastics are used as common materials of hollow containers, such as containers with a lid and bottles, for their excellent molding properties and productivity. However, because plastic hollow containers involve various problems associated with waste disposal, hollow containers made of pulp are conceivable substitutes for plastic containers. Pulp-made hollow containers are not only easy to dispose of but economical because they can be manufactured from used paper.

Known techniques pertaining to pulp-made hollow containers include the technique disclosed in Japanese Patent Laid-Open No. 5-279998. The container disclosed has an angle of 45° or more at which the side walls rise and a depth of 15 mm or more. Because this container is produced by pressing a pulp layer deposited on a papermaking net with a pressing mold and then hot pressed in a metal mold, it is virtually impossible to make the side walls stand at an angle approximately 90° or more and to make the bottom deeper.

A bottle having an annular rib-like projection on its periphery is also known as another technique relating to pulp molded containers. Since the bottle is made by separately forming a pulp layer on each of a pair of splits and then closing the splits to join the two pulp layers, it unavoidably has seams at the joint. Such seams reduce the bottle strength and also impair the appearance.

Accordingly, an object of the present invention is to provide a molded article made mainly of pulp the side walls of which have a large angle to the ground and which has a large depth.

Another object of the present invention is to provide a molded article made mainly of pulp which involves no reduction in bottle strength has a satisfactory appearance, and has a depression or a projection of prescribed shape around the opening or the body thereof.

DISCLOSURE OF THE INVENTION

The present invention achieves the above object by providing a molded article made predominantly of pulp and comprising a bottom portion and a body portion, wherein the angle between the outer surface of a side wall of said body portion and the ground contact plane of said bottom portion is 85° or greater, the height of said body portion is 50 mm or more, and said molded article has corners whose thickness is greater than the thickness of other portions (hereinafter referred to as a first aspect).

The present invention also achieves the above object by providing a molded article made predominantly of pulp and comprising a bottom portion, a body portion and an opening portion, wherein said body portion has a depression or a projection, or said opening portion has an extension extending inward from the peripheral edge thereof said depression or said projection is continuous only in the horizontal or oblique direction provided that said depression or said projection is continuous in a straight line, said body portion is seamless, and said molded article has corners whose thickness is greater than the thickness of other portions (hereinafter referred to as a second aspect).

BEST MODE FOR CARRYING OUT THE INVENTION

Preferred embodiments of the molded article according to the first aspect of the present invention will be illustrated with reference to the accompanying drawings.

Figure 1:
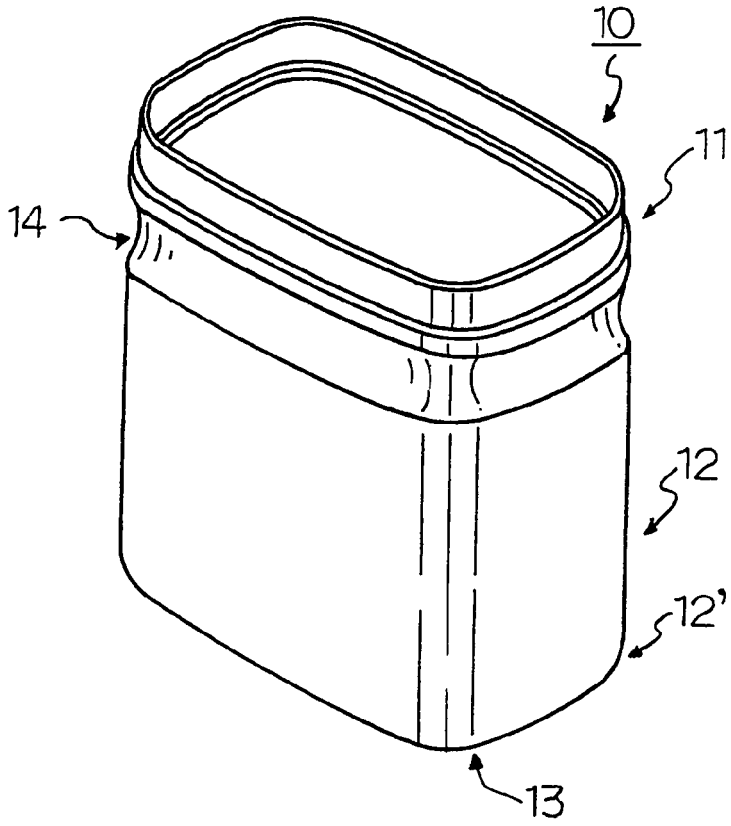
FIG. 1 is a perspective view of an embodiment of the molded article according to the present invention.
Figure 2:
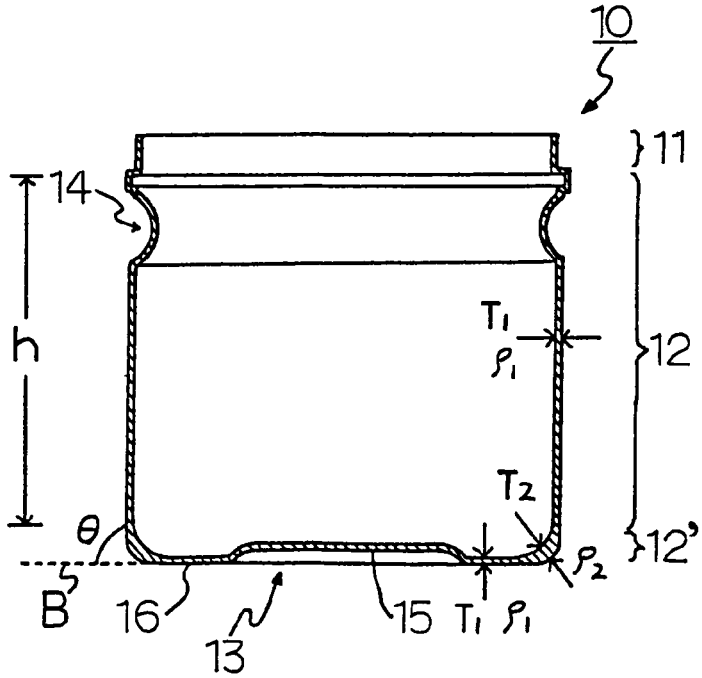
FIG. 2 is a vertical cross-section of the molded article shown in FIG. 1.

FIGS. 1 and 2 show a perspective and a vertical cross-section, respectively, of a molded article 10 according to the first embodiment of the first aspect. The molded article 10 is a hollow container suitable for holding such contents as powder or granules. It has an opening portion 11 in the upper part, a body portion 12, and a bottom portion 13.

The body portion 12 and the bottom portion 13 connect by a curved portion 12' to give the molded article 10 increased impact strength. The curvature of the curved portion 12' is preferably 0.5 mm or more, particularly 5 mm or more, especially 7 mm or more, from the standpoint of improvements on impact strength, drying efficiency, surface finish, and adhesion to a plastic film that is used in the eighth embodiment hereinafter described. The transverse cross-section of the molded article 10 is a rectangle with its four corners rounded to give the molded article 10 increased impact strength. The curvature of the four corners is preferably 0.5 mm or more, particularly 5 mm or more, especially 7 mm or more, for the same reasons as described as for the curved portion 12'. The four sides of the rectangle are gently curved outward. The body portion 12 has a continuous depression 14 around its circumference to make the molded article 10 easy to hold. The depression 14 will be described later in detail.

The front and rear walls making the body portion 12 form straight lines (except for the depression 14) in the height direction of the molded article 10 when seen from the side. Likewise the right and left walls making the body portion 12 form straight lines (except for the depression 14) in the height direction when the molded article 10 is seen from the front.

The bottom portion 13 is made up of a central depression 15 and a heel 16 continuously surrounding the central depression 15. The outer surface of the heel 16 is brought into contact with the ground. Such a configuration of the bottom portion 13 secures stability of the molded article 10 when placed on its bottom.

The molded article 10 has smooth outer and inner surfaces. In case where a plastic layer or a coating layer is formed on the outer and/or the inner surfaces as hereinafter described, the surface smoothness will secure satisfactory adhesion to the layer. Further, the surface smoothness would facilitate neat printing on the outer surface and also provides a better outer appearance. The terminology "smooth" as used herein means that the surface profile of the outer and inner surfaces of the molded article is such that the center-line average roughness (Ra, JIS B0601) is 50 μm or less, and the maximum height ($R_{max}$, JIS B0601) is 500 μm or less.

As shown in FIG. 2, the molded article 10 has every side wall (front, rear, right, and left) of the body portion 12 standing with its outer surface making an angle θ exceeding 85°, preferably 89° or more, to the ground contact plane B of the bottom portion 13 (the angle θ in FIG. 2 is approximately 90°) and a height h (see FIG. 2) of 50 mm or more, preferably 100 mm or more. The angle θ can exceed 90°. It is virtually impossible for the container disclosed in Japanese Patent Laid-Open No. 5-279998 supra, being subject to various designing restrictions, to have its side walls standing at such a large angle and to have such a deep bottom. The present invention gets rid of such inconveniences. The outer surface of the side wall, from which the angle θ is measured, is the part that forms a straight line in the molded article's height direction when viewed from the front or the side of the molded article 10. Accordingly, the outer surface of the depression 14 formed on the body portion 12 is excluded from the object of measurement.

Unlike conventional hollow pulp molded articles, the molded articles 10 according to this embodiment has no seams nor thick-walled parts around the body portion 12 and between the body portion 12 and the bottom portion 13. Thus, the molded article has increased strength and a satisfactory appearance.

The molded article 10 comprising pulp as a major component. Of course it can be 100% pulp made. When other minor materials are used in addition to pulp, the proportion of the other materials is preferably 1 to 70% by weight, particularly 5 to 50% by weight.

Useful other materials include inorganic substances such as talc and kaolinte, inorganic fibers such as glass fiber and carbon fiber, powder or fiber of synthetic resins such as polyolefin, nonwood or plant fibers, and polysaccharides.

The molded article 10 formed of the above-described raw materials preferably has a density (i.e., the density of the wall of the container) of 0.4 to 2.0 g/cm$^3$ to have suitable rigidity as a hollow container, satisfying mechanical properties such as tensile strength, compressive strength, drop strength, and strength at the opening. Still preferably the density is 0.6 to 1.5 g/cm$^3$ to secure an excellent feel on use.

The molded article 10 which has a water vapor transmission rate of 100 g/(m$^2$·24 hrs) or less, preferably 50 g/(m$^2$·24 hrs) or less, as measured in accordance with JIS Z0208, absorbs little moisture in the air and thereby retains moderate rigidity as a hollow container. As a result, the contents are effectively protected against quality deterioration due to water absorption. That is, the contents are given improved storage stability.

It is preferred for the molded article 10 to have a surface tension of 10 dyn/cm or less and water repellency (JIS P8137) of R10. The molded article having such a surface tension and a water repellency can be obtained by molding a paper stock comprising the pulp slurry having incorporated therein additives, such as a waterproofing agent, a water repellant, etc.

The molded article 10 which has a tensile strength of 5 MPa or more, particularly 10 MPa or more, is preferred for inhibiting rupture due to shocks, etc. The term "tensile strength" as used herein means a breaking strength measured by the following procedure in accordance with JIS P8113. A 15 mm wide by 140 mm long specimen is cut out of an arbitrary portion of the molded article 10. The specimen is set on a tensile tester at a chuck distance of 100 mm. Then the specimen is pulled at a pulling speed of 20 mm/min. In case where the molded article cannot afford a specimen of the above size, the size of a specimen to be measured can be changed appropriately.

The molded article 10 which has a specific compressive strength of 100 Nm$^2$/g or more, particularly 110 Nm$^2$/g or more, is preferred, for it is hardly collapsed when stacked up on top of another. The term "specific compressive strength" as used herein is one measured in accordance with JIS P8126.

It is preferred for the molded article 10 to have such a drop strength that it does not break even when dropped 10 times in the drop test specified in JIS Z0217. The opening portion of the molded article 10 preferably exhibits such strength that the force required for pressing the opening portion 11 from its side to give a deformation of 30 mm is 10 N or greater.

It is preferred for the molded article 10 to have a larger thickness at the corners in its vertical cross-section and/or transverse cross-section than the other portions to improve the compressive strength (buckling strength) of the molded article 10 as a whole over the one having equal thickness in every portion. For example, in the vertical cross-section of the molded article 10 shown in FIG. 2, it is preferred that the thickness T2 of the corners, i.e., curved portions 12', be greater than the thickness T1 of the body portion 12 (i.e., T2>T1). In this case, where T2/T1 is 1.5 to 2, the improvement on compressive strength of the whole molded article 10 is further secured. It is preferred that the thickness T1 be 0.1 mm or greater for the molded article 10 to exhibit the minimum compressive strength required. It is required for the molded article 10 to have a prescribed compressive strength, considering that the molded articles 10 are to be transported or stacked up in a warehouse or a shop. Likewise, it is preferred that the molded article 10 has a larger thickness at the corners (T2) than in the other portions (thickness T1) in its transverse cross-section at the body portion shown in FIG. 3.

Where the corners of the molded article 10 in the vertical cross-section and/or the transverse cross-section satisfy the relationship that their density ρ2 is smaller than the density ρ1 of the other portions (i.e., ρ1>ρ2) as well as the above-described relationship between T1 and T2, there is produced an effect that two conflicting phenomena—an improvement in compressive strength of the molded article 10 and a reduction in amount of the material used—can result. This effect is more notable when 0.1×ρ1<ρ2<ρ1. The molded article 10 which satisfies these relationships has a compressive strength of 190 N or greater. The compressive strength as referred to here is the maximum strength in compressing the molded article 10 in the direction of height at a speed of 20 mm/min. The above-described relationships between T1 and T2 and between ρ1 and ρ2 can be established by, for instance, properly selecting conditions in carrying out a preferred method for producing the molded article 10 which will be described later, such as the pressure or flow rate of a pressurizing fluid used in pressing with a pressing member 6, the material or shape of the pressing member 6, the shape of the molded article, and the like.

For example, molded articles 10 which were produced so as to have the T1, T2, ρ1, and ρ2 shown in Table 1 below in their transverse cross-section of the body portion (see FIG. 3) had the compressive strength shown in Table 1. It is seen that the compressive strength increases as the T2/T1 value increases and as the ρ2/ρ1 value decreases. Moreover, the example 2 having a higher compressive strength is lighter. The values T1, T2, ρ1, and ρ2 given in Table 1 are the respective averages of values measured on four positions of the body portion in the height direction.

TABLE 1

| | T1 (mm) | T2 (mm) | T2/T1 | ρ2/ρ1 | Compressive Strength (N) | Weight (g) |
|---|---|---|---|---|---|---|
| Example 1 | 0.550 | 0.593 | 1.078 | 0.928 | 441 | 13.4 |
| Example 2 | 0.595 | 0.835 | 1.403 | 0.713 | 500 | 13.0 |

A preferred method for producing the molded article of the present embodiment will be described with reference to FIG. 4. The molded article 10 of the present embodiment is produced by pulp molding, particularly conveniently by depositing pulp on the inner wall of a cavity formed in a mold. The papermaking step of the steps for producing the molded article 10 by this method is illustrated in sequence in FIGS. 4(*a*) through (*d*), in which (a) is the step of papermaking, (b) is the step of inserting a pressing member, (c) is the step of pressing and dewatering, and (d) is the step of opening a split mold to remove a pulp deposited body.

Figure 4:
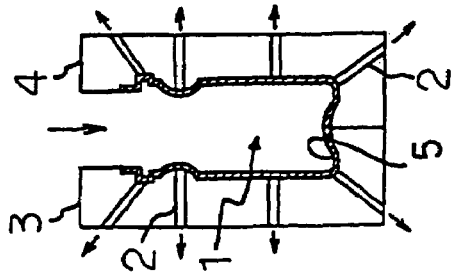
FIGS. 4(*a*), 4(*b*), 4(*c*), and 4(*d*) show in sequence a papermaking step out of the steps for producing the molded article shown in FIG. 1.
Figure 4:
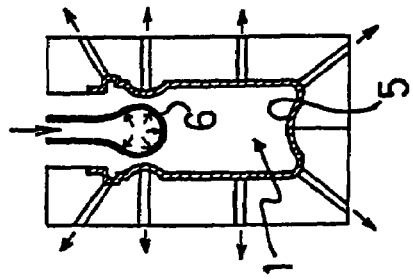
Figure 4:
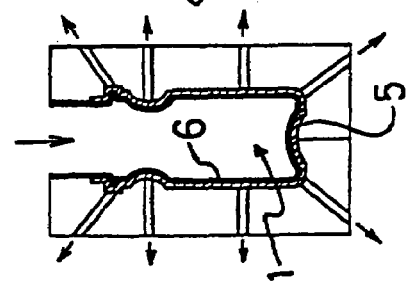
Figure 4:
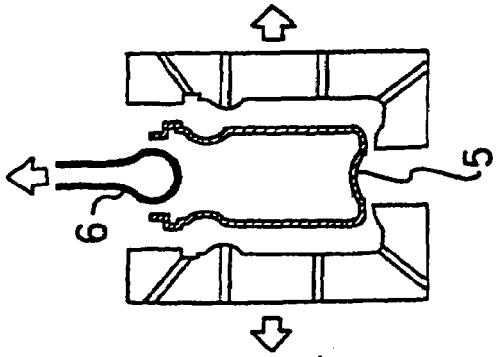

As shown in FIG. 4(*a*), a pulp slurry is poured into a mold having a cavity 1. The cavity 1, formed by joining a pair of splits 3 and 4, has a configuration in conformity to the outer contour of a molded article 10 to be molded. Each of the splits 3 and 4 has a plurality of interconnecting holes 2 which connect the outer side thereof and the cavity 1. The inner surface of the splits 3 and 4 is covered with a net (not shown) of prescribed mesh.

The cavity 1 is evacuated from the outside of the splits 3 and 4 to suck water of the pulp slurry and to deposit the pulp fiber on the inner wall of the cavity 1. As a result, a pulp deposited body 5 is built up on the inner wall of the cavity 1.

On forming the pulp deposited body 5 of prescribed thickness, pulp slurry injection is stopped, and the cavity 1 is completely dewatered by sucking. Subsequently, as shown in FIG. 4(*b*), a hollow, stretchable and elastic pressing member 6 is inserted into the cavity 1 while evacuating the cavity 1 as shown in FIG. 4(*b*). The pressing member 6 is to be inflated in the cavity 1 like a balloon to press the pulp deposited body 5 toward the inner wall of the cavity 1 to transfer the inner configuration of the cavity 1. Therefore, the pressing member 6 is made of urethane, fluorine rubber, silicone rubber, elastomers, etc., which are excellent in tensile strength, impact resilience, stretchability, and the like. The pressing member 6 can be a hollow bag.

As shown in FIG. 4(*c*), a pressurizing fluid is fed into the pressing member 6 to inflate it. The inflated pressing member 6 presses the pulp deposited body 5 to the inner wall of the cavity 1. While the pulp deposited body 5 is pressed onto the inner wall of the cavity 1 by the inflated pressing member 6, the configuration of the inner wall of the cavity 1 is transferred thereto, and dewatering further proceeds at the same time. Since the pulp deposited body 5 is pressed from the inside to the inner wall of the cavity 1 in this manner, the inner configuration of the cavity 1 can be transferred to the pulp deposited body 5 with good precision however complicated the configuration may be. Unlike the conventional production process, the resulting molded article has no seams nor thick-walled parts due to joining since the present process involves no step of joining. As a result, the resulting molded article has secured strength and a satisfactory appearance. The pressurizing fluid for inflating the pressing member 6 includes compressed air (heated air), oil (heated oil) and other liquids. The pressure for feeding the pressurizing fluid is preferably 0.01 to 5 MPa, particularly 0.1 to 3 MPa.

After the configuration of the inner wall of the cavity 1 is sufficiently transferred to the pulp deposited body 5, and the pulp deposited body 5 is dewatered to a prescribed water content, the pressurizing fluid is withdrawn from the pressing member 6, whereupon the pressing member 6 shrinks automatically to its original size as shown in FIG. 4(*d*). The shrunken pressing member 6 is taken out of the cavity 1, and the mold is opened to remove the wet pulp deposited body 5 having the prescribed water content.

The pulp deposited body 5 thus taken out is then subjected to the step of heat drying. In the step of heat drying, the same operation as in the papermaking step shown in FIG. 4 is conducted, except that papermaking and dewatering are not carried out. That is, a mold, which is composed of a pair of splits joined together to form a cavity in conformity to the outer contour of a desired molded article, is heated to a prescribed temperature, and the wet pulp deposited body is set in the mold.

A pressing member similar to the pressing member 6 used in the papermaking step is put into the pulp deposited body, and a pressurizing fluid is fed into the pressing member to inflate it, whereby the pulp deposited body is pressed onto the inner wall of the cavity by the inflated pressing member. The material of the pressing member and the pressure for feeding the pressurizing fluid can be the same as those used in the papermaking step. In this state, the pulp deposited body is dried by heat. After the pulp deposited body dries thoroughly, the pressurizing fluid is withdrawn from the pressing member, and the shrunken pressing member is taken out. The mold is opened to remove the molded article 10.

The molded article 10 thus produced has an angle exceeding 85° between the ground contact plane of the bottom 13 and the outer surface of the side wall of the body 12 and a body 12 height of 50 mm or more. Both the outer and the inner surfaces of the molded article 10 are smooth with no joint seams.

The second aspect of the present invention will be described with reference to FIGS. 5 and 6. The description about the first aspect appropriately applies to the particulars that are not specifically explained here.

Figure 3:
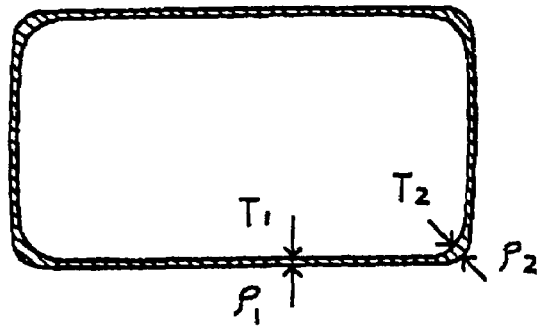
FIG. 3 is a transverse cross-section of the body portion of the molded article shown in FIG. 1
Figure 5:
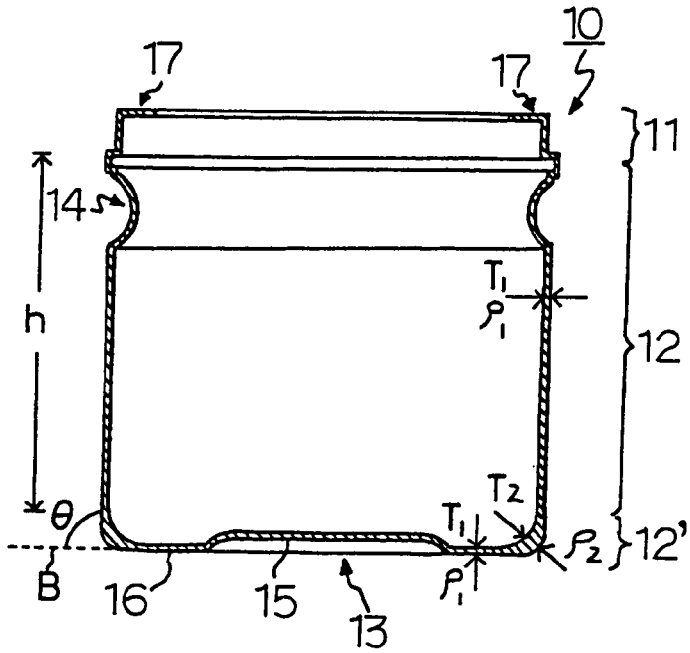
FIG. 5 is a vertical cross-section of an embodiment of the molded article according to the second aspect (corresponding to FIG. 2).
Figure 6:
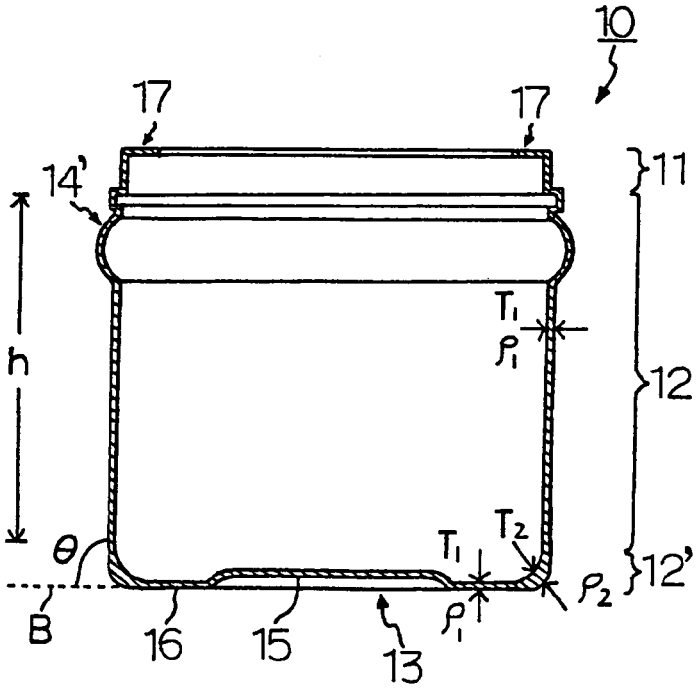
FIG. 6 is a vertical cross-section of another embodiment of the molded article according to the second aspect (corresponding to FIG. 2).

The molded article 10 of the second aspect shown in FIG. 5 has almost the same construction as the molded article of the first aspect shown in FIGS. 1 through 3. The body portion 12 has a continuous depression 14 around its circumference similarly to the first aspect. The molded article 10 shown in FIG. 6 has a projection 14' in place of the depression around the circumference of the body portion 12. Both the molded articles 10 shown in FIGS. 5 and 6 have an extension 7 extending inwardly from the peripheral edge of the opening portion 11. The extension 7 serves to strengthen the opening portion 11. When the opening 11 is closed with seal, etc., the upper side of the extension 17 serves as a sealing surface. The depression 14, the projection 14', and the extension 17 are equivalent to what we call "undercuts" in the field of injection molding of plastics, and the terms "depression", "projection", and "extension" as used herein include any parts equivalent to what is called "undercuts". Accordingly, a depression or a projection formed continuously in a straight line in the vertical direction of the molded article 10, being not equivalent to an undercut, is excluded from what is intended by the term "depression" or "projection" in the context of the present invention. In other words, where a depression or a projection is continuous linearly, it is continuous only in the horizontal direction or an oblique direction of the molded article 10. With conventional pulp molding methods, it has been impossible to make a container having the above-identified depression 14, projection 14' or extension 17 and yet having no seams of joints. Because the molded articles of the present invention are seamless notwithstanding the depression 14, the projection 14' and the extension 17, they are free from the problem of strength reduction and have a satisfactory appearance.

In an embodiment of the second aspect, a depression 14 and/or a projection 14' can be formed to provide the body portion 12 with three-dimensional letters, figures or symbols. Further, the extension 17 of the molded article 10, which is formed on the peripheral edge of the opening portion 11, can be discontinuous.

The second to eighth embodiments of the first aspect of the present invention are then is described with reference to FIGS. 7 through 26. Only the particulars different from the first embodiment will be explained. The description about the first embodiment appropriately applies to the particulars that are not specifically explained here. The members in FIGS. 7 to 26 which are the same as those in FIGS. 1 to 4 are given the same numerical references as used in FIGS. 1 to 4. Unless otherwise noted, the second to eight embodiments of the first aspect shall apply to the second aspect.

Figure 7:
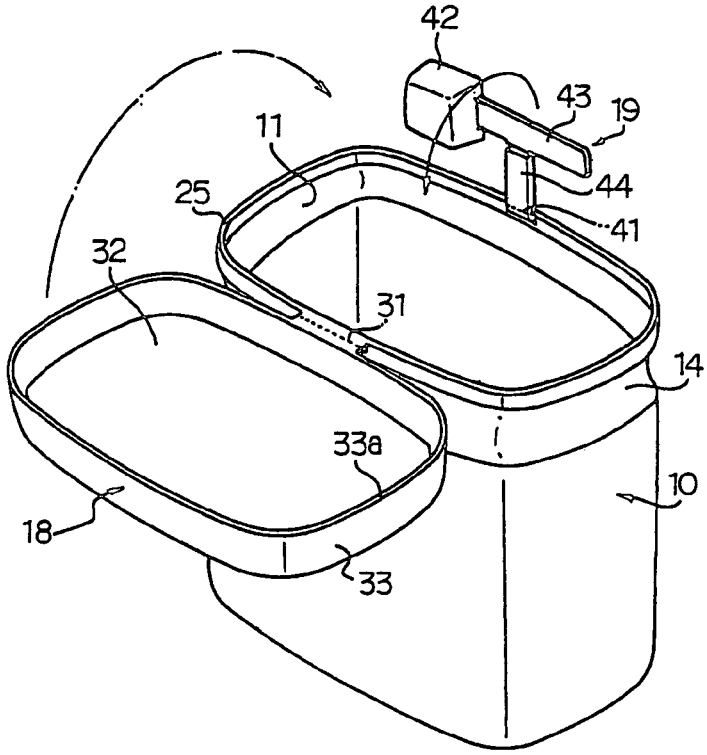
FIG. 7 is a perspective of a second embodiment of the molded article according to the first aspect.
Figure 8:
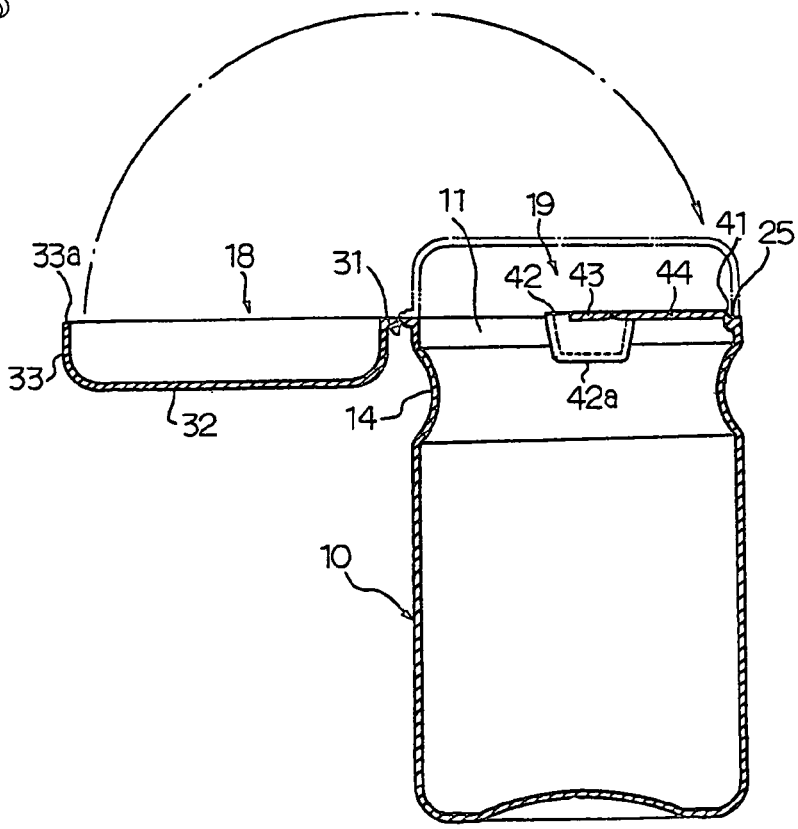
FIG. 8 is a side view of the molded article shown in FIG. 7.

As shown in FIGS. 7 and 8, a molded article of the second embodiment has a lid which swings to open and shut the opening portion 11. The lid and/or a measuring container are connected to the molded article 10 by integral molding via a first hinge and/or a second hinge which is/are thin and dense.

The lid 18, which is integrally molded with the molded article 10, links up with the molded article 10 near the opening portion 11 by the first hinge 31 so as to open and close the opening portion 11. The lid 18 consists of a flat top 32 and peripheral wall 33 standing upright from the peripheral edge of the top 32 so that the lower edge 33*a* of the peripheral wall 33 may be brought into, or out of, contact with the fitting part of the molded article 10. The lid 18 and the molded article 10 link up between the lower edge 33*a* of the peripheral wall 33 of the former and the horizontal contact part 25 of the latter.

The measuring container 19 is also integrally molded with the molded article 18 similarly to the lid 18. The measuring container 19 links up with the molded article 10 by the second hinge 41. The measuring container 19 is a scoop composed of a cup 42, which is a closed-end rectangular cylinder, and a handle 43 integrally connected to the cup 42. The measuring container 19 connects up with the molded article 10 near the opening portion 11 by a linking part 44 having the second hinge 41. As shown in FIG. 8, the measuring container 19 swings on the second hinge 41 to be put inside the molded article 10 without projecting over the opening portion 11. This construction permits the opening portion 11 to be sealed with seal, etc.

The lid 18 and the measuring container 19 are integrally molded together with the molded article 10 and link up with the molded article 10 via the first hinge 31 and the second hinge 41, respectively. The first hinge 31 is a thin and dense part formed in a linking part between the lid 18 and the molded article 10. The second hinge 41 is a thin and dense part formed in a linking part between the measuring container 19 and the molded article 10.

More specifically, the linking part which links the lid 18 and the molded article 10 and the linking part which links the measuring container 19 and the molded article 10 each have a linear groove having a prescribed cross-section to make the first hinge 31 and the second hinge 41. The lid 18 swings in an arc on the first hinge 31 to open and shut the opening portion 11 of the molded article 10. The measuring container 19 similarly swings on the second hinge 41 to be put inside the molded article 10.

The first hinge 31 and the second hinge 41 are thinner than the other portions of the molded article 10, the lid 18 and the measuring container 19. The thickness T1 at the thinnest of the first and second hinges 31 and 41 (see FIG. 9) is preferably 0.05 mm or greater and from 5 to 100%, still preferably 15 to 80%, of the other portions of the molded article 10, the lid 18 and the measuring container 19 in order to obtain excellent flexing property and durability. While every part of the molded article 10, the lid 18, and the measuring container 19 can be of a thickness and a density except the first and second hinges, the preferred range of the thickness T1 of the first and second hinges and a preferred range of the density of the first and second hinges (hereinafter described) are represented based on the thickness and density of the body portion 12 of the molded article 10 as a standard.

The first and second hinges 31 and 41 are denser than the other portions of the molded article 10, the lid 18 and the measuring container 19. For obtaining excellent flexing properties and durability, the density of the first and second hinges 31 and 41 is 1.05 to 20 times, preferably 2 to 20 times, particularly preferably 2 to 5 times, that of the other portions of the molded article 10, the lid 18 and the measuring container 19. From the same viewpoint, a preferred density of the hinges 31 and 41 is 0.4 to 2.0 g/cm$^3$. The density of the hinge is a maximum density of the hinge, which is calculated from thickness and weight measurements per given area.

For obtaining excellent flexing properties and durability, it is preferred for the first and second hinges 31, 41 to have a tensile strength of 5 MPa or greater and a specific compressive strength of 100 N·m$^2$/g or greater. From the same standpoint, the width of the first and second hinges 31, 41 (the width in the direction of linking the molded article 10 with the lid 18 or the measuring container 19) is preferably 0.2 mm or more, particularly 1 mm or more.

The "width of the hinge" as referred to here is the smallest width of the groove on the side facing outward when the linking part is bent.

Figure 9:
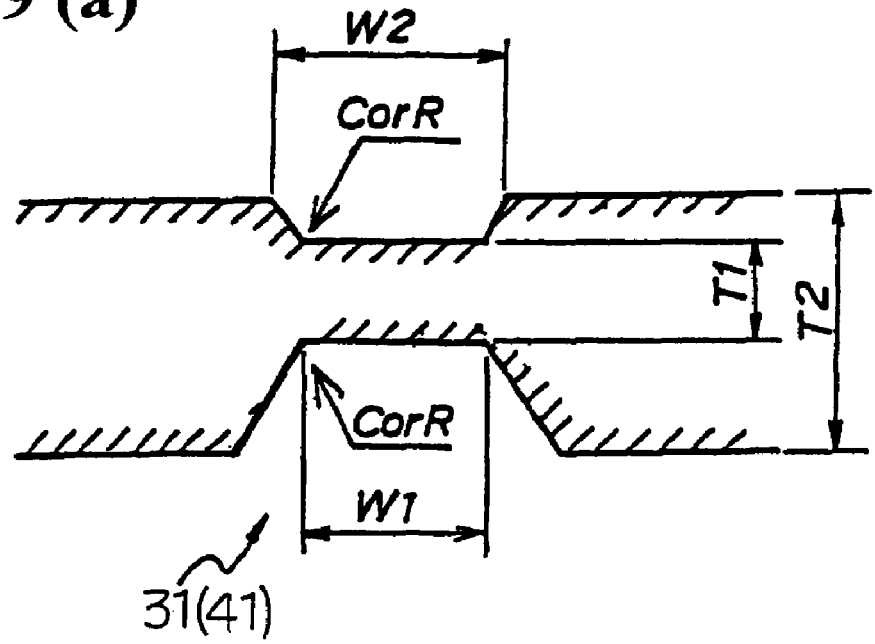
FIGS. 9(*a*) and 9(*b*) each show a cross-section of a preferred configuration of a first hinge and a second hinge.
Figure 9:
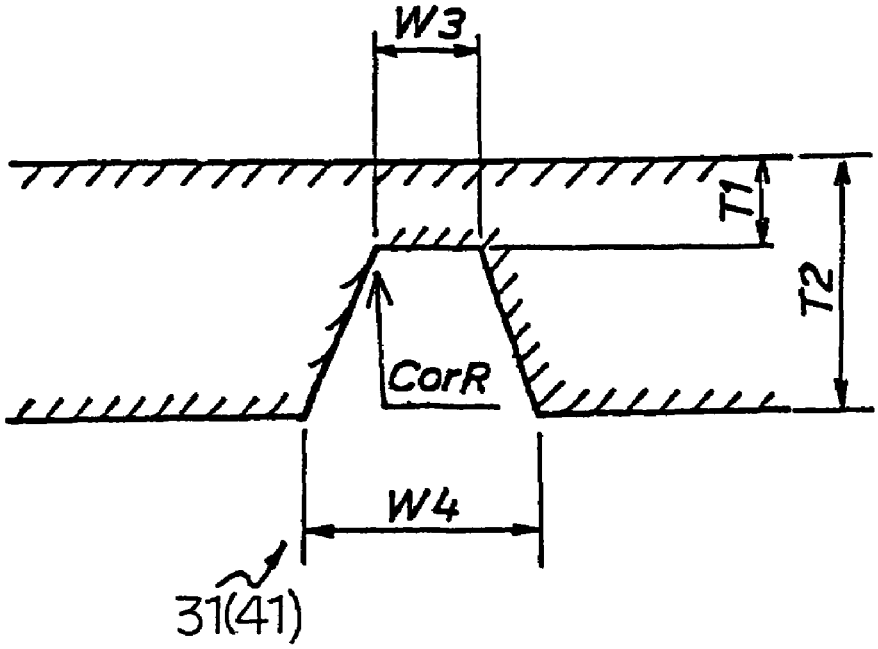

Two preferred configurations of the hinges 31 and 41 are shown in FIG. 9. The hinge of FIG. 9(*a*) is formed by making a groove on both the upper and the lower sides of the linking part between the molded article 10 and the lid 18 or the measuring container 19. The hinge of FIG. 9(*b*) is formed by making a groove on only the lower side of the linking part. The upper side in FIG. 9 corresponds to the side facing inward when the linking part is bent. The "width of the hinge" is, in FIG. 9(*a*), a width W1 of the lower side groove at the deepest; and, in FIG. 9(*b*), a width W3 of the groove at the deepest. The angular part in the grooves indicated by symbol "CorR" is preferably chamfered or rounded. Preferred dimensions of each part of the hinges shown in FIG. 9 are as follows. The width W2 in FIG. 9(*a*), which is the width of the groove facing inward on bending as measured on the surface level, is preferably 1 mm or greater. The width W3, which is at the deepest of the hinge of FIG. 9(*b*), is preferably 0.2 mm or greater and equal to or smaller than the width W4, which is the width of that groove on its surface level. The width W4 is preferably 1 mm or greater.

In the present embodiment, it is preferred that not only the molded article 10 but the lid 18 and the measuring container 19 be made mainly of pulp.

Since the first hinge 31 which connects the lid 18 and the molded article 10 is thin and dense as described above, repeated swings of the lid 18 do not cause the inconvenience of the hinge 31's being torn off. Therefore, the molded article 10 is favorable for use as a container from which the contents are repeatedly taken out in small portions.

Also linking up with the molded article 10 by the second thin and dense hinge 41, the measuring container 19 is not torn off the molded article 10 at the linking part during transportation. Bent and put inside the molded article 10, the measuring container 19 does not fall off during transportation. On use, the measuring container 19 is cut off the molded article 10 at the linking part 44 with a pair of scissors or a cutter.

Since the molded article 10, the lid 18 (and the measuring container 19) are integrally molded, the production process can be simplified to reduce the production cost. Not only the molded article 10 but the lid 18 (and the measuring container 19), being made mainly of pulp, can easily be disposed of. These portions can be produced from used paper, which is economically advantageous.

Figure 10:
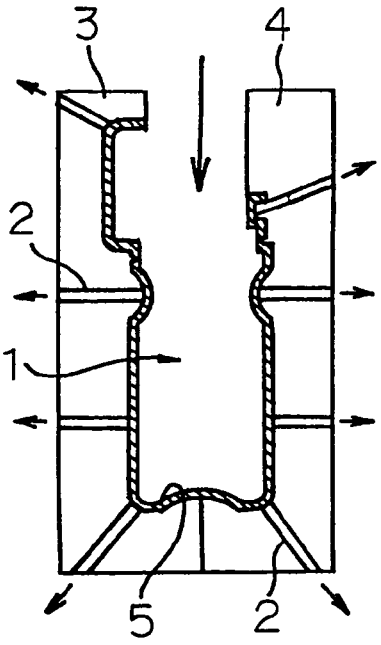
FIG. 10 schematically shows a pulp slurry being injected into a mold which is preferably used in the production of the molded article shown in FIG. 7.

The molded article 10 according to the present embodiment can be produced almost in the same manner as shown in FIG. 4 by use of a mold shown in FIG. 10. In detail, the lid 18 and the measuring container 19 are integrally molded together with the molded article 10 by a papermaking technique to obtain a molded article precursor, which is a pulp deposited body obtained after papermaking and dewatering. A part of the linking part between the molded article 10 and the lid 18 or the measuring container 19 is compressed to form the first hinge 31 and the second hinge 41. The term "molded article precursor" as used herein means a pulp fiber deposited body having a given shape which is obtained after papermaking and dewatering steps. A molded article after pressing and drying steps is also included under this term.

The difference between the method of producing the molded article of this embodiment and that shown in FIG. 4 is that the molded article precursor after the heat drying step is once removed from the mold and placed on a separate member, or the molded article precursor after the heat drying step is kept in contact with a half of the split mold, and the parts of the precursor that become the first and second hinges 31 and 41 are compressed to form the first and second hinges 31 and 41. The compression is preferably carried out by pressing the parts becoming the first and second hinges 31 and 41 with long and narrow projections whose cross-sections correspond to the shapes of the first hinge 31 and the second hinge 41, respectively. Where the molded article precursor is the one after the papermaking and dewatering steps but before the heat drying step, the formation of the first hinge 31 and/or the second hinge 41, which are made thinner and denser than the other portions, can be carried out more easily and efficiently by compressing the parts that become the first and second hinges 31 and 41.

According to the above-described method, the molded article 10 of the present embodiment can be produced efficiently and economically.

The molded article 10 can also be produced by depositing pulp on the inner surface of a papermaking mold, such as a base mold having a net laid thereon or a porous mold, to form a pulp layer, dewatering the pulp layer in a known manner, transferring the resulting molded article precursor to either a female mold or a male mold making a couple, and pressing and drying the precursor with a mating male or female mold. In this method, the first hinge 31 and/or the second hinge 41 can be formed by compressing the corresponding parts of the precursor after the pressing and drying step. The first hinge 31 and/or the second hinge 41 can also be formed simultaneously with the pressing and drying step by pressing the corresponding parts with projections for hinge formation provided on the corresponding parts of a pressing and drying mold. Where the first and second hinges 31 and 41 are formed during the pressing and heating step, a movable pressing member can be provided on part of the mold so that the precursor may be pressed by this member in an appropriate stage in the pressing and drying step to form the first and second hinges 31 and 41. This method is also efficient in producing the molded article 10 according to the present embodiment.

While the molded article 10 according to the present embodiment has both the lid 18 and the measuring container 19 linked to the molded article 10 near the opening portion 11 by the thin and dense hinges 31 and 41, respectively, it is conceivable that the molded article 10 has either one of the lid 18 and the measuring container 19 linked thereto by a thin and dense hinge. The measuring container 19 can be omitted. The measuring container 19 is not particularly limited and can be of various shapes and capacities, provided that the object of measuring is fulfilled.

Figure 11:
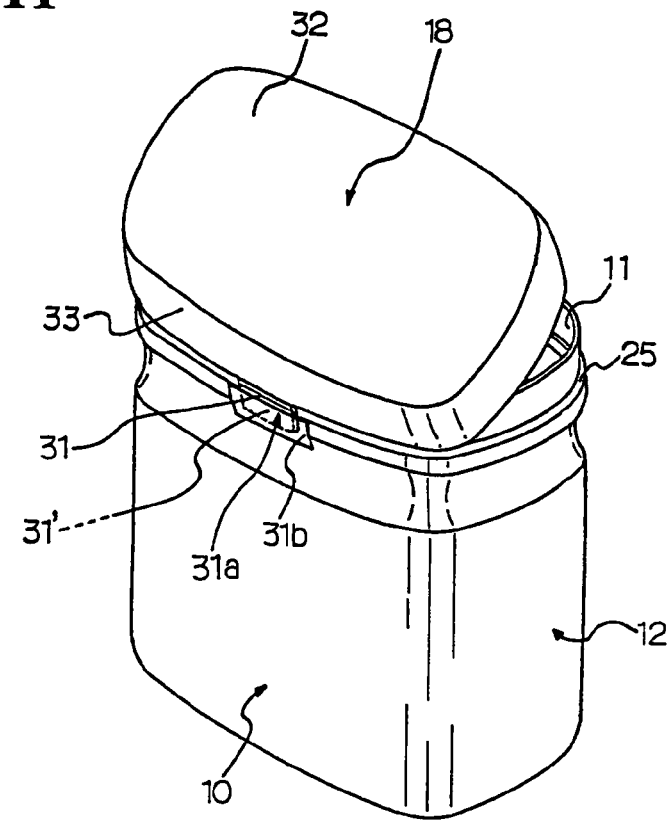
FIG. 11 is a perspective of a third embodiment of the molded article according to the first aspect.
Figure 12:
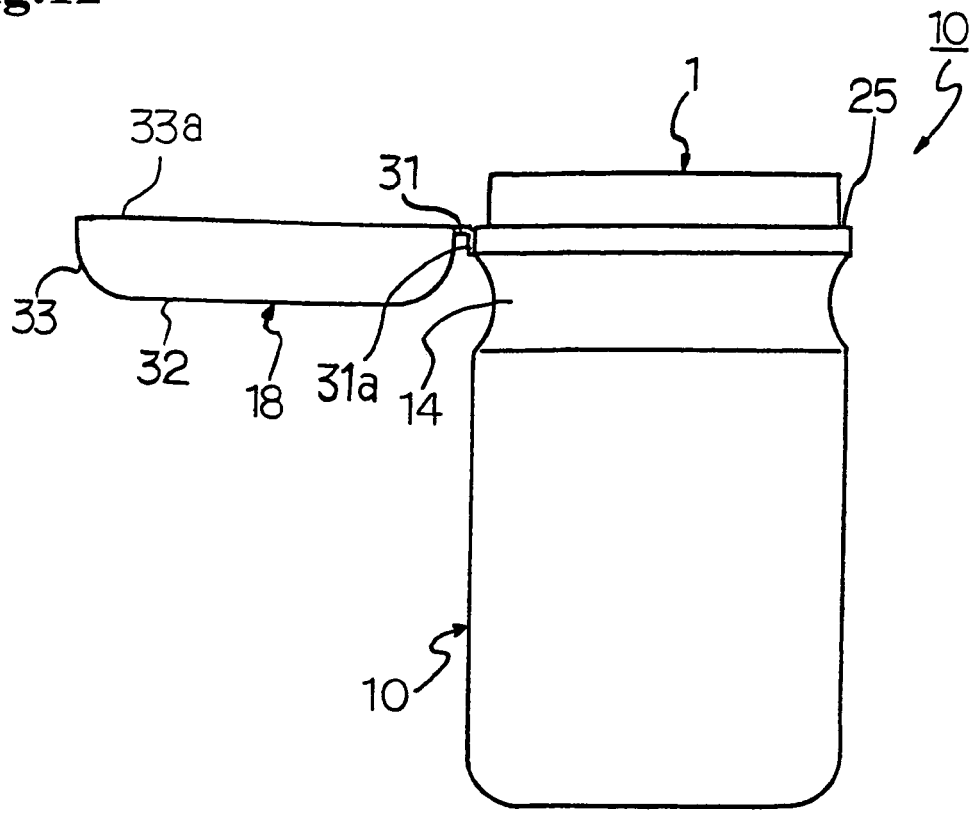
FIG. 12 is a side view of the molded article shown in FIG. 11.

A molded article of the third embodiment has a lid for opening and shutting the open top thereof as shown in FIGS. 11 and 12. The lid is a part which is separately prepared from the molded article and has a linking part with a hinge through which it is fixed to the molded article.

In detail, the lid 18 is made separately from the molded article 10. It is fixed to the molded article 10 via the linking part 31' having the hinge 31 which is provided on the lid 18. The structure of the lid 18 is the same as in the second embodiment.

The linking part 31' is provided at the lower edge 33*a* of the peripheral wall 33 as an integral part that is formed by integral molding together with the lid 18. The linking part 31' is almost rectangular and has the hinge 31 in the middle thereof. The lid 18 in this embodiment is formed mainly of pulp, and the hinge 31 is formed as a thin and dense part of the linking part 31'. More specifically, a long, narrow, and straight groove having an arched cross-section is made in the middle of the linking part 31' to form the hinge 31. The part of the linking part 31' that is farther than the hinge 31 is a joint face 31*a* which is adhered to the body portion 12 of the molded article 10. In the present embodiment, the linking part 31' is adhered to the body portion 12 by bringing the joint face 31*a* into contact with the body portion 12 and sticking an adhesive sealing member 31*b* over the joint face 31*a* as shown in FIG. 11. The lid 18 is thus fixed so that it can swing in an arc on the hinge 31 to open and close the opening portion 11 of the molded article 10.

Preferred configurations of the hinge 31 are the same as those shown in FIG. 9. Other details of the first hinge in the second embodiment also apply to the hinge 31.

As stated previously since the molded article 10 according to the present embodiment has the lid 18, which is prepared separately from the molded article 10, fixed to the molded article 10, it is produced without using a large sized mold, which is productive and economical.

In producing the molded article of the present embodiment, the linking part 31' is integrally molded together with the lid 18 by a papermaking method, and a part of the linking part 31'-forming part of the molded article precursor after papermaking and dewatering is compressed to form the hinge 31. The term "molded article precursor" as used herein has the same meaning as defined with respect to the second embodiment. The term "linking part 31'-forming part" as used herein indicates a part which finally becomes the linking part 31'.

The molded article 10 can be produced by the same method as shown in FIG. 4 for the first embodiment. The lid 18 can be produced through almost the same steps as for the molded article 10.

That is, the steps from papermaking and dewatering up to heat drying are carried out in the same manner as for the preparation of the molded article 10, except for using a mold composed of a pair of splits forming a cavity configuration in conformity to the contour of the lid 18 to be molded.

Figure 13:
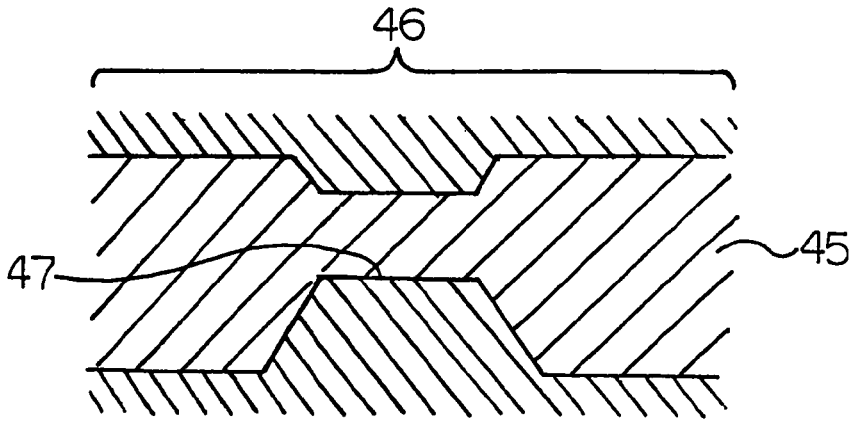
FIG. 13 schematically illustrates hinge formation in an embodiment of the method of producing the molded article shown in FIG. 11.

The molded article precursor after the heat drying step is once removed from the mold and placed on a separate member, or the molded article precursor after the heat drying step is kept in contact with a half of the split mold. In this state, a part of the linking part 31'-forming part of the molded article precursor is compressed to form the hinge 31. As shown in FIG. 13, the compression is preferably performed by pressing a part of the linking part 31'-forming part 46 of the molded article precursor 45 with projections 47 whose cross-sections correspond to the shape of the hinge 31. The lid 18 thus prepared is fixed to the molded article 10 via the linking part 31' in such a manner that it can swing on the hinge 31 to be fitted to the fitting part of the molded article 10. With respect to the other particulars of the hinge formation that have not been described, the corresponding description given to the hinge formation in the second embodiment appropriately applies.

In the present embodiment, the shape and the number of the linking part(s) 31' are not particularly limited as long as the lid 18 and the molded article 10 are linked together thereby.

For example, a spaced pair of linking parts 31' can be attached to the molded article 10. As long as the linking part 31' can be fixed to the molded article 10, the manner of fixing is not particularly restricted. For instance, the joint face 31*a* can be adhered to the outer surface of the molded article 10 directly with an adhesive, or a hole can be made in the molded article 10 into which part of the linking part 31' can be fitted. It is also possible to omit the linking part 31' and to link the lid 18 to the molded article 10 by means of tape made of paper, etc. The linking part 31' can be attached to any position of the molded article 10 provided that the lid 18 is fixed in such a manner that it may open and close the opening portion 11 of the molded article 10.

The lid 18 does not always need to be made mainly of pulp but can be an injection molded part made of a synthetic resin.

Figure 14:
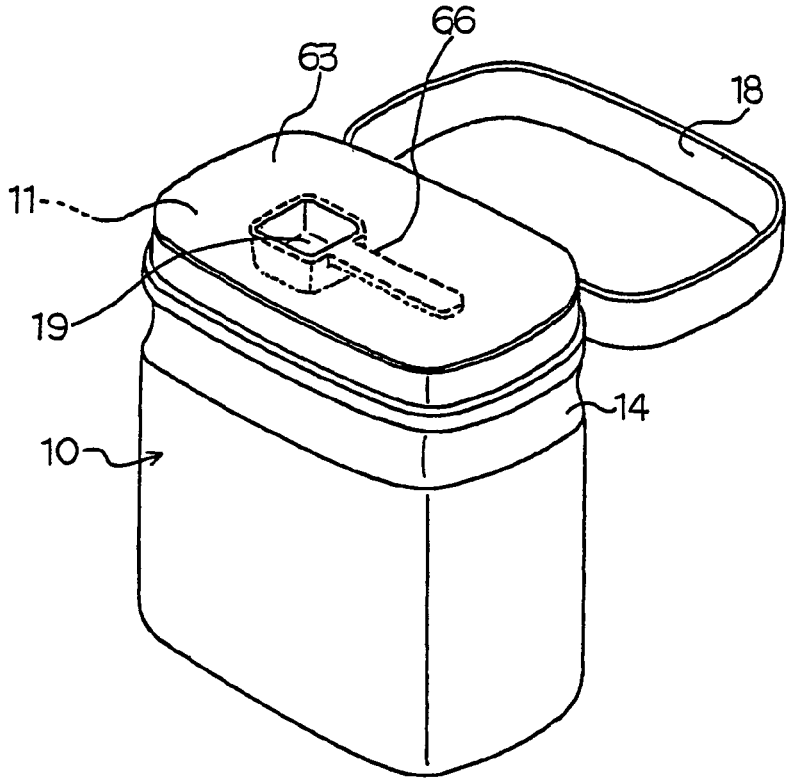
FIG. 14 is a perspective of a fourth embodiment of the molded article according to the first aspect.

A molded article according to the fourth embodiment has its upper opening covered with a seal and a measuring container removably set on the seal as shown in FIG. 14.

According to this embodiment, the measuring container can easily be taken out for use without soiling a user's hand and with no need of assembly.

As shown in FIG. 14, a seal 63 having a removable measuring container 19 is provided to cover the upper surface of the opening portion 11 of the molded article 10.

In the present embodiment, both the seal 63 and the measuring container 19 are made by pulp molding. They can easily be prepared by integral molding according to the method described, e.g., in Japanese Patent Laid-Open No. 5-279998.

That is, a pulp component is extracted from a pulp slurry on a papermaking net formed into the integral shape of the seal 63 and the measuring container 19. The formed pulp layer is pressed from the upper side with a pressing mold made of an elastic material to remove the water content from the pulp layer to obtain a molded container precursor, which is hot pressed to obtain easily an integral pulp molded article which is the seal 63 having a three-dimensional measuring container 19 as a depression.

After the integral molding, a cutting line is printed along the border between the seal 63 and the measuring container 19, or discontinuous cuts, perforations or thinner parts are made along the border thereby to make it easy to separate the measuring container 19 from the seal 63 by hand. Perforations, etc. can be made by molding.

After the molded article 10 is filled with, for example, powdered detergent, the seal 63 having the measuring container 19 as an integral part thereof is adhered at its periphery to the upper end of the molded article 10 with an adhesive to cover the opening portion 11 of the molded article 10. The powdered detergent is thus sealed in. Thereafter, the pulp molded lid 18, which is hinged to the upper side of the molded article 10, is swung shut.

On use, the lid 18 is swung open, the seal 63 is removed to open the molded article 10, and the measuring container 19 is separated from the seal 63. A predetermined amount of the powdered detergent can be measured with the measuring container 19 and put into a washing machine, etc.

According to the present embodiment, since the measuring container 19 is removably set on the seal 63, it does not bury itself in powdered detergent, causing no such troubles for a user to find it out or soil her or his hand to take it out.

Further, because the molded article 10, the seal 63, the measuring container 19, and the lid 18 are all formed by pulp molding, they are easy to dispose of.

In the present embodiment, the seal, the measuring container and the lid do not always need to be pulp molded articles and can be made of plastics and the like. Removably setting the measuring container to the seal may be such that the measuring container is releasably adhered to the seal with an adhesive.

Figure 15:
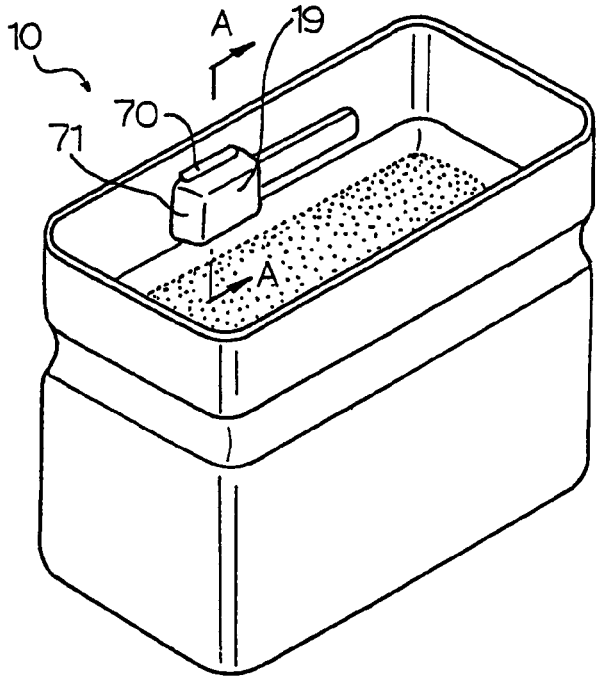
FIG. 15 is a perspective of a fifth embodiment of the molded article according to the first aspect.

A molded article according to the fifth embodiment has a fitting part for a measuring container integrally molded as shown in FIG. 15.

According to this embodiment, the measuring container is fitted to a prescribed position of the molded article so that it is easily detached.

As shown in FIG. 15, fitting projections 70 are integrally formed on the upper inner wall of the molded article 10, between which a cup 71 of a three-dimensional measuring container 19 made of plastics, etc. is detachably fixed.

Figure 16:
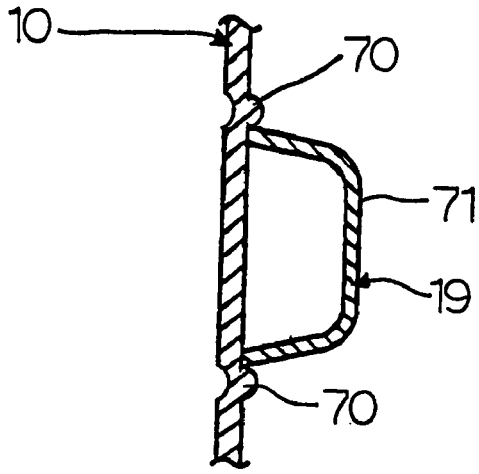
FIG. 16 is a cross-section of FIG. 15 taken along line A-A, showing a measuring container being fitted between fitting projections.

As shown in FIG. 16, the fitting projections 70 for fitting the measuring container 19 to the upper inner wall of the molded article 10 are a pair of an upper rib and a lower rib each having a semicircular cross-section which are parallel to each other at a spacing corresponding to the distance between two facing edges of the cup 71 so that the two edges of the cup 71 may be fitted in. The cup 71 of the measuring container 19 is laterally slid in between the pair of the fitting projections 70 with its edges in contact with the inner wall of the molded article 10. The two edges of the cup 71 are thus fastened by the upper and lower fitting projections 70, and the measuring container 19 is fixed to the inner wall of the molded article 10. On use, the measuring container 19 is easily detached by sliding backward. The fitting projections 70 are integrally molded together with the molded article 10.

Since the molded article 10 according to the present embodiment has a pair of the fitting projections 70 on its upper inner wall as a fitting part for the three-dimensional measuring container 19, it can hold the measuring container 19 fixed thereto. Therefore, the measuring container 19 is not buried in powdered contents due to vibrations, etc. and can easily be taken out. The fitting projections 70 being formed on the upper inner side of the molded article 10, the measuring container 19 is positioned above the powdered contents so that it can be taken out without soiling a user's hand.

In the present embodiment, the measuring container can be disposed on the outer side or lower part of the molded article or on the seal instead on the upper inner side of the molded article. The measuring container fitting part is not limited to the rib-like projections and can be composed of other various projections formed as integral parts by a pulp molding method.

Figure 17:
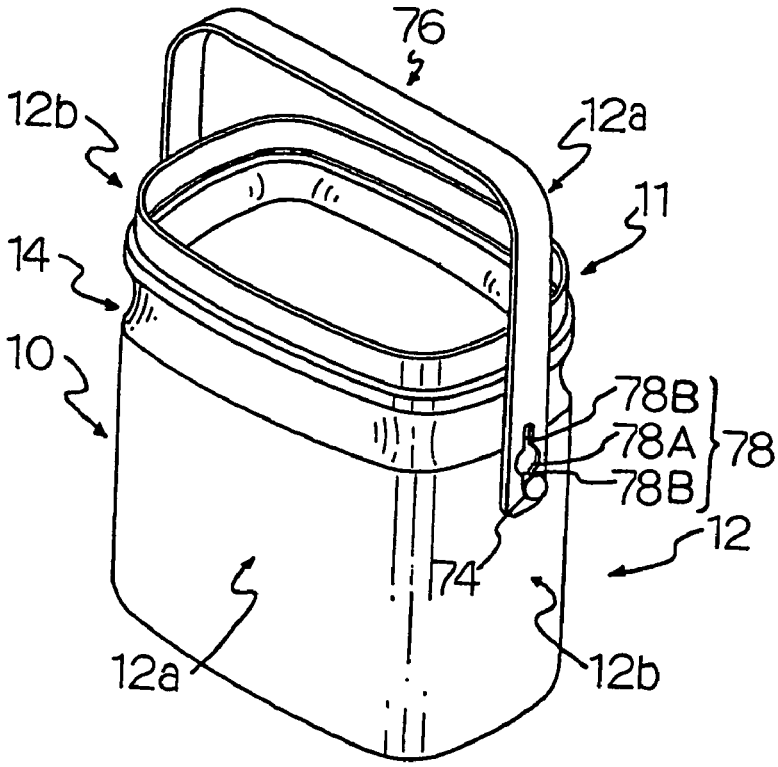
FIG. 17 is a perspective of a sixth embodiment of the molded article according to the first aspect.

A molded article according to the sixth embodiment has a fitting part for a handle on its body portion, on which a handle is hooked up as shown in FIG. 17.

According to this embodiment, a molded article equipped with a handle which is easy to dispose of or recycle is provided at a low cost of production. In particular, a molded article and a handle both of which are made of pulp would be easier to dispose of or recycle.

The body portion 12 of the molded article 10 is made up of a front and a rear wall 12*a* and 12*a* and a right and a left wall 12*b* and 12*b*. A pair of fitting parts for a handle 74 and 74 are provided, one on the right wall 12*b* and the other on the left wall 12*b* at positions facing each other. The fitting parts 74 are formed mainly of pulp similarly to the molded article 10. They are integral with, or separate from, the right and the left walls. The fitting parts 74 which are separate parts are attached to the right and the left walls 12*b* and 12*b* by means for joining, such as an adhesive or caulking. Totally made mainly of pulp, the molded article 10 is easy to dispose of with no necessity to separate into parts for separate disposal.

Figure 18:
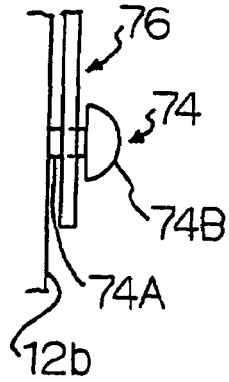
FIG. 18 is an enlarged view of a fitting part for a handle.

An enlarged view of the fitting part 74 is shown in FIG. 18. Seen from the side, the fitting part 74 has the shape of a mushroom, being composed of a columnar stem 74A and a semispherical cap 74B connected to an end of the stem 74A.

The handle 76 to be fitted to the fitting parts 74 has a U-shape. A fitting hole 78 is made through the handle 76 near each end of the U-shape at facing positions. Each fitting hole 78 has a shape composed of a circular hole 78A and a pair of oblong holes connecting to the circular hole 78A, the oblong holes being on the line passing through the center of the circular hole 78A. The diameter of the circular hole 78A is almost equal to or slightly greater than that of the cap 74B of the fitting part 74. The width of the oblong holes is almost equal to or slightly greater than that of the diameter of the stem 74A of the fitting part 74. The handle 76 is fitted to the molded article 10 by passing the cap 74B of the fitting part 74 of the molded article 10 through the circular hole 78A of the fitting hole 78 of the handle 76 and then pulling the handle 76 upward to fit the stem 74A of the fitting part 74 into the oblong hole 78B of the fitting hole 78 of the handle 76.

The handle 76 can be of plastics as conventionally used but is preferably made mainly of pulp similarly to the molded article 10 to exclude the necessity to dispose of separately.

In the production of the molded article according to the present embodiment, the fitting parts 74 can be formed by integral molding with the molded article 10 or formed separately from the molded article 10.

In the present embodiment, the fitting parts 74 may be metallic pins instead of pulp molded parts.

Figure 19:
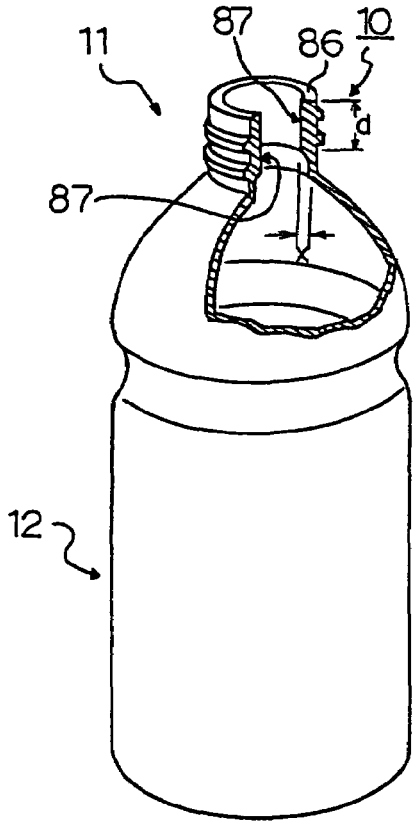
FIG. 19 is a perspective of a seventh embodiment of the molded article according to the first aspect.

A molded article 10 according to the seventh embodiment shown in FIG. 19 is a cylindrical bottle having a thick-walled portion 87 in its opening portion 11 in the area from the upper edge 86 to a prescribed depth d, which is thicker than the body portion 12 and the bottom portion 13. The thick-walled portion 87 is continuous along the circumference of the opening portion 11. For some uses of the molded article 10, the thick-walled portion 87 may be discontinuous.

The whole opening portion 11 from the upper edge 86 to the base of the neck could be a thick-walled portion 87, but it is sufficient for the opening portion 11 to have the thick-walled portion 87 from its upper edge 86 to a prescribed depth d shown in FIG. 19 as long as sufficient mechanical strength is secured. The depth d is usually 0.5 to 50 mm, preferably 5.0 to 30 mm, while dependent on the use, the shape, and the like of the molded article.

As shown in FIG. 19, the thick-walled portion 87 projects inward. The degree of projection, represented by the width x of the projection (see FIG. 19) in the horizontal direction measured from the inner wall of a part having no such a thick-walled portion 87 in the opening portion 11, is 0.5 to 5.0 mm, preferably 1.0 to 3.0 mm, which suffices to secure the mechanical strength of the opening portion 11. Having an increased area, the upper surface 86 of the opening portion 11 offers an increased sealing surface area to enhance the adhesive strength to a seal, etc. when it is sealed.

Sufficient mechanical strength is secured for the opening portion 11 when the depth d and the width x of the projection is such that d/x is from 0.1 to 100, preferably 1 to 30. The part of the opening portion 11 that is deeper than the depth d can be tapered so that the width x of the projection gradually approaches zero as shown in FIG. 6.

It is preferred for the upper surface 86 of the opening portion 11 to be smooth to secure improved sealability when it is sealed with a seal, etc. Sufficient sealability will be secured with the upper surface 86 having such smoothness as to have a center-line average roughness (Ra) of about 50 μm or smaller and a maximum height ($R_{max}$) of about 500 μm or smaller. The upper surface 86 can be made smooth by, for example, a post treatment such as polishing by a prescribed means after the production of the molded article 10. Preferably, a sufficiently smooth upper surface 86 is obtained without the above-described post treatment by producing the molded article by use of the papermaking mold hereinafter described.

A preferred method for producing the molded article according to this embodiment will be described by referring to FIGS. 20 to 22.

The molded article 10 of the present embodiment is preferably produced by use of a papermaking mold which comprises:

a set of splits, each having a plurality of interconnecting holes connecting the outside and the inside, which are joined together to form a cavity in conformity to the outer contour of an article to be molded and a mold for creating stagnation which is to be inserted into the above-described cavity to form a space where a slurry stagnates.

Figure 20:
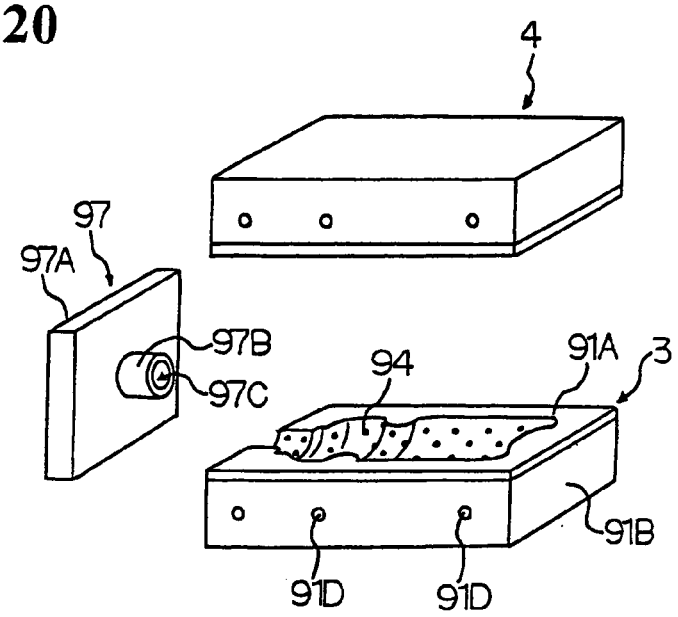
FIG. 20 is an exploded perspective of a mold which is preferably used in the production of the molded article according to the seventh embodiment.

FIG. 20 shows an exploded perspective view of the mold used to produce the molded article of the present embodiment. The mold comprises a set of splits 3 and 4 having the same structure as the splits 3 and 4 shown in FIG. 4 except for the cavity configuration and a mold 97 for causing stagnation (hereinafter "stagnation-making mold") which is inserted from the outside into the cavity to form a space with the inner wall of the cavity, in which space a slurry stagnates. The inner wall of the split 4, while not shown in FIG. 20, has the same configuration as that of the mating split 3.

Figure 21:
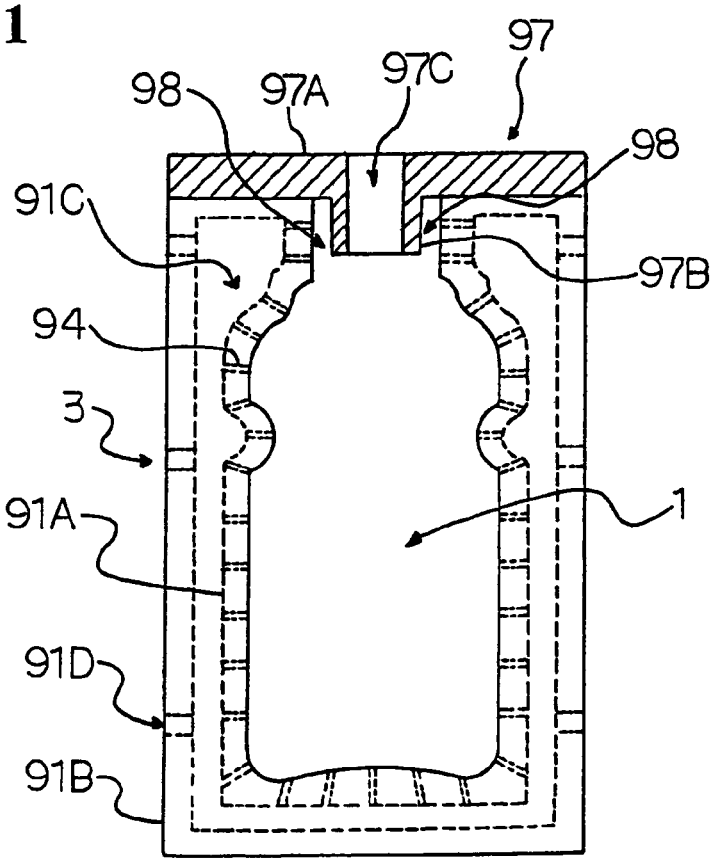
FIG. 21 is a vertical cross-section of the mold shown in FIG. 20, taken along the parting face.

As shown in FIGS. 20 and 21, the split 3 is composed of a papermaking part 91A and a manifold part 91B. The papermaking part 91A is fitted into the manifold part 91B to make up the split 3. With this fitting, there is formed a manifold 91C between the papermaking part 91A and the manifold part 91B. The inner side of the papermaking part 91A may be covered with a net of prescribed mesh. A plurality of interconnecting holes 94, 94, . . . are regularly pierced through the papermaking part 91A from the inner to the outer surfaces. These interconnecting holes 94 connect with the manifold 91C. A plurality of suction holes 91D are also pierced in both sides of the manifold part 91B thereby to form interconnecting passageways in the split 3 which connect the outside of the manifold part 91B and the inner surface of the papermaking part 91A.

On joining the splits 3 and 4 together, there is formed a cavity 1 in conformity to the contour of an article to be molded as shown in FIG. 20. The part of the cavity 1 that corresponds to the opening portion 11 of the molded article (hereinafter referred to as "the cavity part corresponding to an opening portion") has an opening open to the outside. Into this part is inserted a wall 97B for making the slurry stagnant (hereinafter "a slurry stagnation wall", described later) of the stagnation-making mold 97. While not depicted, the inner side of the cavity part corresponding to the opening portion has grooves corresponding to a screw thread.

As shown in FIGS. 20 and 21, the stagnation-making mold 97 is composed of a rectangular top plate 97A and a cylindrical slurry stagnation wall 97B hanging from approximately the center of the lower side of the top plate 97A. The slurry stagnation wall 97B makes a hollow cylinder which vertically pierces the stagnation-making mold 97 and serves as a gate 97C through which a slurry is poured into the mold. The slurry stagnation wall 97B of the stagnation-making mold 97 is inserted into the cavity part corresponding to the opening portion, and the lower side of the top plate 97A and the upper end of the split mold 3, 4 are brought into contact to complete the mold.

The diameter of the slurry stagnation wall 97B is smaller than that of the cavity part corresponding to the opening portion. Therefore, with the slurry stagnation wall 97B inserted in the cavity part corresponding to the opening portion, an annular space 98 in which a slurry stagnates is formed between the inner wall of that part of the cavity and the outer side of the slurry stagnation wall 97B.

Figure 22:
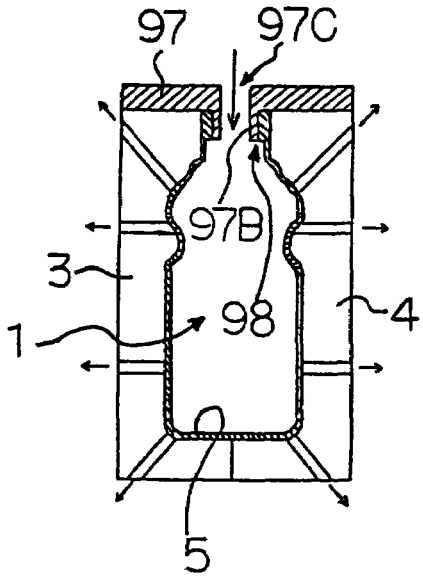
FIGS. 22(*a*) and 22(*b*) show part of a papermaking step out of the steps for producing the molded article according to the embodiment shown in FIG. 19.
Figure 22:
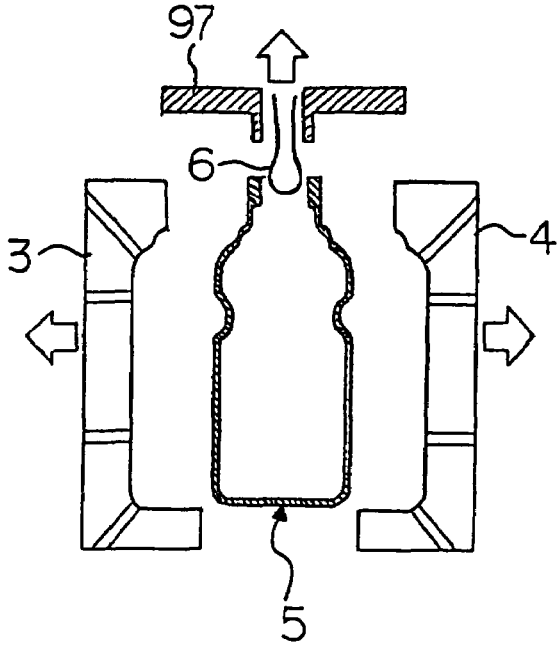

FIGS. 22(*a*) and (*b*) illustrate part of a papermaking step, one of the steps for producing the molded article 10 by use of the above-described mold, wherein (a) is the papermaking step, and (b) is the step of opening the mold and removing a pulp deposited body. In FIG. 22, part of the mold is omitted from the illustration for the sake of simplicity.

As shown in FIG. 22(*a*), an injection pump (not shown) is started to suck up a pulp slurry from a pulp slurry storage tank (not shown) and inject the pulp slurry under pressure into the mold through the slurry gate 97C. Then, the cavity 1 is evacuated by suction from the outside of the splits 3 and 4, thereby to suck up the water content of the pulp slurry and to build up pulp fibers on the inner wall of the cavity 1. The pulp slurry easily goes around to fill the annular space 98 formed between the outer side of the slurry stagnation wall 98B and the inner side of the cavity part corresponding to the opening portion and stays there, making the pulp fibers be accumulated there more than on the other parts of the cavity 1. Since the pulp slurry is injected into the cavity 1 under pressure, the pulp slurry pressure is equal in every part of the cavity 1 so that the annular space 98 can sufficiently be filled with the pulp slurry. It follows that the pulp deposited body 5 formed on the inner wall of the cavity 1 has a larger wall thickness in its upper edge and its vicinities than in the other portions. The thickness of the thicker portion corresponds to the breadth of the annular space 98.

Then, the same steps as the step of inserting a pressing member and the step of pressing and dewatering shown in FIGS. 4(*b*) and (*c*) are carried out. As shown in FIG. 19, the resulting molded article 10 can have sufficiently enhanced strength in its thick-walled portion 87 near the upper surface 86 of the opening portion 11 particularly through the pressing and dewatering step.

After the shape of the inner wall of the cavity 1 is sufficiently transferred to the pulp deposited body 5, and the pulp deposited body 5 is dewatered to a prescribed water content, the pressurizing fluid in the pressing member 6 is withdrawn, and the pressing member 6 is removed from the cavity 1 as shown in FIG. 22(*b*). The mold is opened, and the pulp deposited body 5 in a wet state with a prescribed water content is taken out. Thereafter, the pulp deposited body 5 is forwarded to the step of heat drying in the same manner as in the method for producing the molded article of the first embodiment to obtain the molded article 10.

As stated above, the molded article 10 thus produced has a thick-walled portion 87 in the opening portion 11 from the upper surface 86 to a prescribed depth d, which is thicker than the body portion 12 and the bottom portion 13. In addition, the upper surface 86 is so smooth as to exhibit sufficient adhesive strength when sealed with a seal, etc. without being given any special post treatment.

The thick-walled portion 87 in the molded article 10 of the present embodiment can project both inward and outward. If desired, the part of the thick-walled portion projecting outward can serve as, for example, a projection for fitting a cap on.

Figure 23:
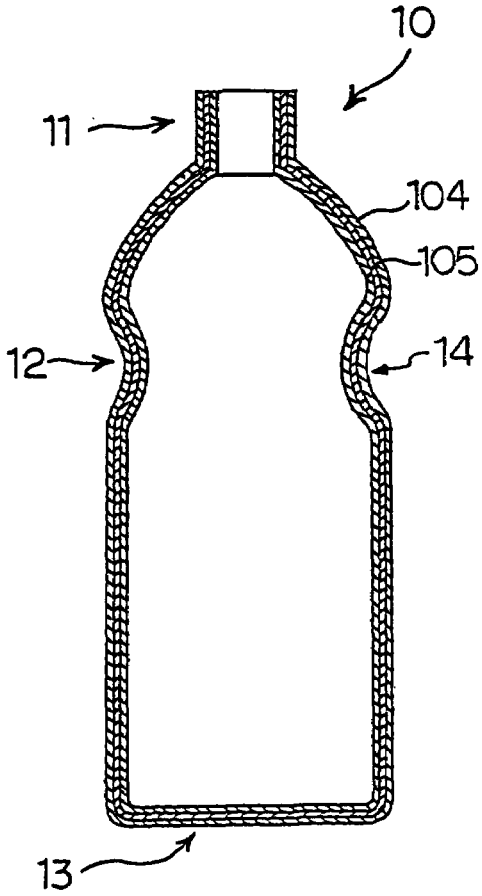
FIG. 23 is a vertical cross-section of an eighth embodiment of the molded article according to the first aspect.

A molded article 10 of the eighth embodiment which is shown in FIG. 23 has a thin plastic layer on its outer surface 104 and inner surface 105. Such plastic layers not only give the molded article 10 further increased strength but effectively prevent leaks of the contents. Because the outer surface 104 and the inner surface 105 of the molded article 10 are smooth, the plastic layers can be satisfactorily adhered to the outer surface 104 and the inner surface 105. While the thickness of each plastic layer is selected appropriately according to the wall thickness of the molded article 10, the kind of the contents and the like, it is usually 5 to 300 μm, particularly 10 to 200 μm, especially 20 to 100 μm. The two plastic layers may be the same or different in thickness. The materials constituting each plastic layer include various thermoplastic synthetic resins such as polyethylene and polypropylene, emulsion latices such as an acrylic emulsion, and waxes such as a hydrocarbon wax.

Where, in particular, the molded article 10 is laminated with a plastic film, the plastic is chosen from appropriate materials according to the purpose of laminating, for example imparting water resistance or gas barrier properties. For instance, a film of a polyolefin, e.g., polypropylene or polyethylene, a polyester, e.g., polyethylene terephthalate or polybutylene terephthalate, polystyrene, polycarbonate, etc. can be used. A multilayer film composed of a plurality of films made of these materials can also be used.

A plastic layer can be formed on the inner surface of the molded article 10 by, for example, replacing the pressing member 6 having elasticity used in the molded article production method shown in FIG. 4 with a pressing member of bag form made of a plastic film of polyethylene or polypropylene, etc., the plastic film having aluminum or silica deposited thereon, the plastic film laminated with aluminum foil, etc., and the like. After the pulp deposited body 5 is pressed by such a pressing member of bag form, it is not taken out but remains superposed on the inner surface of the pulp deposited body 5 thereby to form a plastic layer on the inner surface of the molded article 10.

A plastic layer can also be formed on the inner surface of the molded article 10 by replacing the elastic pressing member with a closed-end cold parison (preformed parison) having been preheated to a predetermined temperature. The parison is inserted into the pulp deposited body 5, and a pressurizing fluid is fed into the parison to inflate it. The plastic film is thus adhered to the inner surface of the pulp deposited body thereto to form a plastic layer on the inner surface of the molded article 10.

Figure 24:
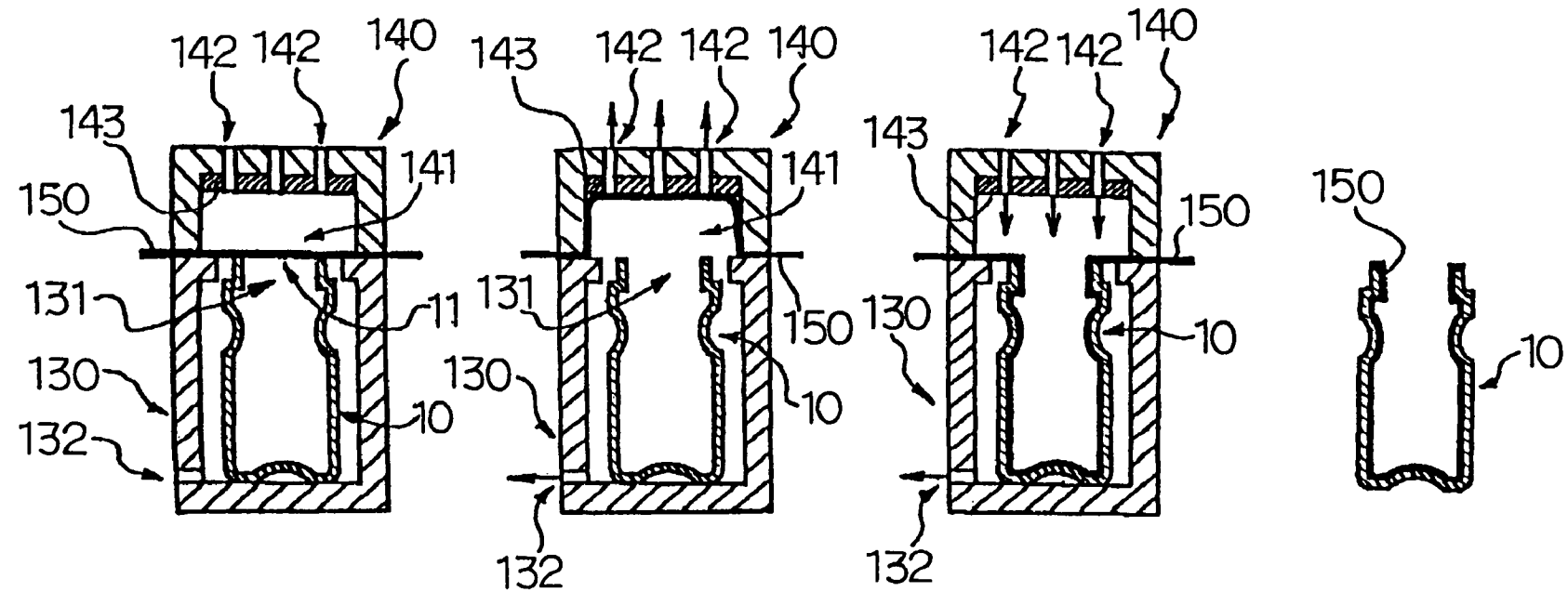
FIGS. 24(*a*), 24(*b*), 24(*c*), and 24(*d*) show in sequence the step of laminating the inner surface of a molded article with a plastic film.

As an alternative for laminating the inner surface of the molded article 10 with a plastic film, vacuum forming or pressure forming is also useful. The method depicted in FIG. 24 is suitable. In this method a first vacuum chamber 130 and a second vacuum chamber 140 are used as shown in FIG. 24(*a*). The first vacuum chamber 130 has an opening 131 at the top and a through-hole 132 in the side wall near the bottom. The through-hole 132 is connected to a suction means not shown. The inner shape of the cross-section of the opening 131 is made slightly larger than the outer contour of the cross-section of the opening portion 11 of the molded article 10. On the other hand, the second vacuum chamber 140 has an opening 141 at the bottom. The opening 141 of the second vacuum chamber 140 is shaped to close the opening 131 of the first vacuum chamber 130. The inner shape of the cross-section of the opening 141 is made larger than that of the opening 131 of the first vacuum chamber 130. The upper side of the second vacuum chamber 140 has a plurality of through-holes 142, 142 . . . , which are connected to a suction means not shown. A heating means 143, such as an electric heater, is provided on the inner wall of the upper side of the second vacuum chamber 140.

The inner surface of a molded article 10 can be laminated with a plastic film by use of the vacuum chambers 130 and 140 as follows. As shown in FIG. 24(*a*), a molded article 10 is placed in the first vacuum chamber 130 with its opening portion 11 up. The depth of the first vacuum chamber 130 is virtually the same as the height of the molded article 10 so that the upper opening edge of the placed molded article 10 and that of the first vacuum chamber 130 are almost even.

In this state a stretchable plastic film 150 in its unstretched state is placed to close the opening 131. Larger than the cross-section of the first vacuum chamber 130, the plastic film 150 closes the opening 131 and also covers all the upper surface of the opening 131. Subsequently, the second vacuum chamber 140 is set on the first vacuum chamber 130 with its opening 141 facing the plastic film 150. Since the first and the second vacuum chambers 130 and 140 are of the same shape in their cross-sections, the plastic film 150 are held in between the periphery of the opening 131 of the first vacuum chamber 130 and the periphery of the opening 141 of the second vacuum chamber 140. Each of the first and the second vacuum chambers 130 and 140 is thus made air-tight. To maintain sufficient air tightness in each vacuum chamber, the two vacuum chambers may be fastened together by a fixing means such as a metal fastener.

The second vacuum chamber 140 is then sucked by a suction means (not shown) connected to the through-holes 142, whereby the second vacuum chamber 140 is evacuated, and the plastic film 150 is drawn up in the second vacuum chamber 140 and stretched gradually. On continuing evacuating the second vacuum chamber 140, the plastic film 150 is further stretched and comes into close contact with the inner wall of the second vacuum chamber 140 as shown in FIG. 24(*b*). The stretching in this stage is preliminary. The stretch ratio is decided appropriately in accordance with the shape of the molded article 10 to be laminated with the plastic film 150. In general, when the plastic film 150 is preliminarily stretched with the ratio of the surface area of the preliminarily stretched plastic film 150 to that of the plastic film superposed on the molded article 10 (the former/the latter) being 3 to 0.7, particularly 2 to 0.9, laminating the molded article 10 with the plastic film 150 can be accomplished with improved adhesion, and laminating the molded article 10 having a complicated shape is carried out more easily. The pressure (degree of vacuum) in the second vacuum chamber 140 is such that the plastic film 150 may be preliminarily stretched to come into intimate contact with the inner wall of the second vacuum chamber 140. While depending on the thickness and material of the plastic film 150, the pressure is generally 40 kPa or lower, preferably 1 to 1300 Pa.

While the preliminarily stretched plastic film 150 is in intimate contact with the inner wall of the second vacuum chamber 140, it is heated to a prescribed temperature by the heating means 143 provided on the inner wall of the upper side of the second vacuum chamber 140. The plastic film 150 is softened by this heating to further secure the intimate contact of the plastic film 150 with the molded article 10 in laminating and to further facilitate laminating the molded article 10 having a complicated shape. For example, in using polyethylene or polypropylene having a glass transition temperature (Tg) of room temperature (23° C.) or lower as a constituent material of the plastic film 150, the heating temperature preferably ranges from (melting point +30)° C. to (melting point −70)° C., particularly from (melting point +5)° C. to (melting point −30)° C. In using polyethylene terephthalate or polystyrene whose Tg is room temperature or higher as a constituent material, the heating temperature preferably ranges from (Tg +5)° C. to (Tg +150)° C., particularly (Tg +10)° C. to (Tg +100)° C. Within these ranges, the plastic film 150 can be superposed with closer contact on the molded article 10 without tearing. Where the plastic film 150 is made of two or more kinds of materials, the glass transition temperature of the material having the lowest glass transition temperature is taken as the above-described glass transition temperature.

While the plastic film 150 being in close contact with the inner wall of the second vacuum chamber 140 by suction, the first vacuum chamber 130 is evacuated by a suction means (not shown) connected to the through-hole 132. Since there is a gap between the inner wall of the opening 131 of the first vacuum chamber 130 and the outer wall of the opening portion 11 of the molded article 10, the inside and the outside of the molded article 10 connect with each other to let gas flow therethrough. Therefore, the above evacuation by suction creates a vacuum in the first vacuum chamber 130, i.e., the inside and the outside of the molded article 10 similarly to the inside of the second vacuum chamber 140. In this state, the plastic film 150, which has been in intimate contact with the inner wall of the second vacuum chamber 140, is not drawn into the first vacuum chamber 130 by the evacuation of the first vacuum chamber 130. While not particularly limiting, a preferred pressure (degree of vacuum) of the first vacuum chamber 130 is usually 40 kPa or lower, particularly 1 to 1300 Pa.

Then, the evacuation of the second vacuum chamber 140 is stopped. Further, the vacuum in the second vacuum chamber 140 is broken and, at the same time, pressure is applied into the second vacuum chamber 140 to a predetermined pressure. These operations can be performed instantaneously by switching a three-way valve, etc. Because the first vacuum chamber 130 is in the evacuated state, the plastic film 150 which has been in intimate contact with the inner wall of the second vacuum chamber 140 is instantaneously drawn and stretched toward the inside of the first vacuum chamber 130, i.e., the inside of the molded article 10 in the present embodiment, whereby the inner surface of the molded article 10 is laminated with the plastic film 150 with intimate adhesion as shown in FIG. 24(*c*). In other words, the plastic film 150 is stretched in the direction opposite to the direction of preliminary stretching. Having been heated to a predetermined temperature until the vacuum of the second vacuum chamber 140 is broken, the plastic film 150 can be stretched and adhered to the molded article 10 extremely smoothly, being effectively prevented from, e.g., tearing on stretching. Pressure application into the second vacuum chamber 140 is carried out with a prescribed pressurizing fluid, conveniently air. In order for the plastic film 150 to be brought into intimate contact with the molded article 10 without tearing, the pressure to be applied is preferably 100 to 3000 Pa, particularly 200 to 1000 Pa.

Where laminating the molded article 10 with the plastic film 150 is conducted with the molded article 10 being heated to a predetermined temperature, the plastic film 150 can be superposed on the molded article 10 with further improved adhesion while being prevented from tearing more effectively. This is because satisfactory stretchability of the plastic film 150 is maintained during the laminating. The molded article 10 can be heated by, for example, a prescribed heating means provided on the inner side of the side wall of the first vacuum chamber 130. A preferred heating temperature of the molded article 10 is from 40 to 150° C. for preventing re-shrinkage of the plastic film 150 and securing the production efficiency.

After the plastic film 150 is superposed, the evacuation by suction of the first vacuum chamber 130 is stopped, and the inner pressure is increased to atmospheric pressure. The second vacuum chamber 140 is then removed, and the molded article 10 laminated with the plastic film 150 is taken out of the first vacuum chamber 130. At this time point, there remains the free plastic film 150 around the opening portion of the molded article 10, which is trimmed to give the molded article 10 shown in FIG. 24(*d*) which has the inner surface thereof and the upper edge of its opening portion intimately laminated with the plastic film 150.

According to the above-mentioned method of production, the plastic film 150 can be superposed on the molded article 10 with good adhesion without tearing even if it is stretched at a stretch ratio as high as 4 to 10, the stretch ratio of the plastic film 150 being defined as a ratio of the surface area of the plastic film 150 superposed on the molded article 10 and the opening area of the opening 131 of the first vacuum chamber 130 (the former/the latter).

The above production method has a merit that the molded article 10 can be laminated with a film irrespective of whether or not it has air permeability. Further, because it is not necessary to evacuate through the wall of the molded article 10, the time required for evacuation by suction can greatly be shortened as compared with conventional vacuum forming and the like to markedly improved the productivity. Furthermore, the molded article 10 does not suffer from deformation by evacuation, it is not necessary to use a reinforcing mold as in conventional vacuum forming and the like, which leads to production cost reduction.

Where the above-described laminating method is adopted, it is preferred to use a stretchable film as the plastic film. In this case, it is preferred for the plastic film to have a thickness of about 5 to 200 μm, particularly about 20 to 100 μm, after laminating so as to impart desired characteristics such as water resistance and gas barrier properties to the molded article. The thickness before laminating, while varying depending on the desired thickness after laminating, the stretch ratio, etc., preferably ranges from about 50 to 1000 μm, particularly about 100 to 500 μm, from the viewpoint of handling properties during the production and the plastic film heating efficiency.

In carrying out laminating with the plastic film 150 shown in FIG. 24, where the molded article 10 is placed upside down (the opening portion 11 of the molded article 10 facing downward), the outer surface of the molded article 10 can be laminated with the plastic film 150. It is possible to laminate both the inner surface and the outer surface (except the bottom surface) of the molded article 10 with a single plastic film at the same time by making the opening 131 of the first vacuum chamber 130 extremely larger than the outer contour of the opening portion 11 of the molded article 10 to provide a wide gap between the opening 131 of the first vacuum chamber 130 and the opening portion 11 of the molded article 10. In this case, another film can be set between the bottom portion of the molded article 10 and the inner wall of the bottom of the first vacuum chamber 130 so that the inner and the outer surfaces, including the bottom surface, of the molded article 10 may be laminated with the two films simultaneously.

When the molded article having the inner and/or the outer surfaces thereof laminated with the plastic film is left to stand at 60° C. for 30 minutes, the plastic film preferably has a shrinkage percentage of 30% or less, particularly 10% or less.

If the shrinkage percentage exceeds 30%, there is a fear that the plastic film peels in parts and that tearing of the molded article 10 initiates from the parts where the plastic film peels. That is, long-term storage stability reduces. The shrinkage percentage is obtained from the distance between two arbitrary points on the plastic film-laminated surface of a molded article measured before and after the storage under the above-described conditions according to formula: (1−distance before storage/distance after storage)×100. The shrinkage percentage can be made 30% or less by, for example, heating the plastic film-laminated molded article to the glass transition point of the plastic film or a higher temperature, followed by slow cooling. Where the plastic film is a laminate comprising two or more plastic materials, the heating is at or above the glass transition point of the plastic material having the lowest glass transition point.

There is another embodiment for forming a plastic layer on the outer and/or the inner surfaces of a molded article, which comprises powder coating the outer and/or the inner surfaces of the molded article to form a plastic layer(s).

If a solvent- or water-based coating is used for plastic layer formation, the plastic layer tends to form micropores while the solvent or the like evaporates, resulting in a failure to manifest sufficient gas barrier properties (shielding against water or oxygen). There is also a fear that the solvent, etc. may deform the molded article. A plastic layer formed by powder coating is free from these disadvantages, providing a molded article with sufficient gas barrier properties.

Powder which can be used for powder coating includes powder of olefin resins, polyester resins, epoxy resins, acrylic resins, etc. The powder can consist solely of the resin or, if necessary, it can be colored by addition of various pigments. In addition, conventional additives known to be useful in coating compositions can be used with no particular restriction. Such additives include leveling agents, e.g., acrylate polymers and silicone resins, and pinhole preventing agents, e.g., benzoin. These additives are added in an amount of about 0.1 to 5 parts by weight each per 100 parts by weight of the resin. The total thickness of the plastic layer(s) (the total of the plastic layers formed on the outer and the inner surfaces of a molded article) is decided appropriately according to the use of the molded article, the wall thickness, the kind of the contents, and the like and is usually from 50 to 600 μm. From the standpoint of water vapor permeability, productivity, and cost, a preferred total thickness is 100 to 400 μm.

Powder coating can be carried out with a coating gun, which has at the tip thereof a nozzle equipped with a corona electrode for forcibly charging the powder simultaneously with ejecting a powder coating. The powder coating ejected and charged simultaneously adheres to the surface to be coated, i.e., the outer and/or the inner surfaces of the molded article by electrostatic force. To secure the adhesion, it is preferred to apply a voltage of −10 to −80 kV, particularly −40 to −70 kV, to the powder coating.

Application of the powder coating is followed by a baking step in which the applied powder coating is melted and hardened to form a plastic layer. A baking oven capable of heating to a prescribed temperature is used for baking. From the standpoint of productivity, smoothness of the coating film, and prevention of scorching, the baking is carried out at a temperature of 70 to 230° C., particularly 140 to 200° C., for a period of 1 to 20 minutes, particularly 5 to 20 minutes.

There is still another embodiment for forming a plastic layer on the outer and/or the inner surfaces of a molded article, which comprises applying a resin solution or a resin emulsion to the outer and/or the inner surfaces of a molded article to form a plastic layer. In this embodiment, the plastic layer preferably has a thickness of 5 to 300 μm, particularly 20 to 150 μm, and the ratio of the thickness of the plastic layer to the thickness of the molded article (the former/the latter) is preferably 1/2 to 1/100, particularly 1/5 to 1/50.

If the thickness of the plastic layer is smaller than 5 μm, the waterproofing and water vapor proofing effect tends to be insufficient for giving the contents sufficient storage stability. If the thickness exceeds 300 μm, the plastic layer needs time for drying, and the coating tends to sag while applied, resulting in such defects as unevenness of thickness. The thickness of the plastic layer can be measured by microscopic observation of the section of the molded article. The molded article according to this embodiment has a clear boundary between the pulp fiber which constitutes the molded article and the resin which constitutes the plastic layer unlike an article of which the plastic layer is formed by coating a molded article with a coating composition in a conventional manner. That is, in a conventional method, an aqueous solution of a polymer penetrates into an undried molded article so that the boundary between the pulp fiber and the polymer is indefinite, whereas the molded article of the present embodiment is less pervious to the resin to make the boundary definite. As a result, the molded article can be made waterproof and water vapor proof with a smaller amount of the resin than needed conventionally, and the pulp fiber can be disintegrated more easily when recycled.

If the thickness ratio of the plastic layer to the molded article exceeds 1/2, disintegrability in recycling is poor. If it is less than 1/100, sufficient waterproofness and water vapor proofness cannot be obtained. The thickness of the molded article is appropriately decided according to the use, etc. so that the above ratio may fall within the range of from 1/2 to 1/100. The thickness is preferably 100 to 3000 μm, still preferably 500 to 2000 μm.

The resin used in the coating composition for forming a plastic layer includes acrylic resins, styrene-acrylic resins, ethylene-vinyl acetate resins, styrene-butadiene rubber resins, polyvinyl alcohol resins, vinylidene chloride resins, waxes, fluorine resins, silicone resins, and copolymers and polyblends of these resins.

In order to control penetration of the coating composition into the molded article, it is preferred for the molded article to have a void of 30 to 70%, particularly 40 to 60%. The void is calculated from the following formula (1). In formula (1), the density of a molded article is calculated from the weight and the thickness of a piece cut out of the molded article, and the density of the material which constitutes the molded article is calculated from the proportions of pulp fiber and other components and the density.

$$\text{Void (\%)} = 1 - \frac{\text{Density of Molded Article}}{\text{Density of Material constituting Molded Article}} \times 100 \quad (1)$$

With too small the void, the molded article may be too impervious to the coating composition, tending to have reduced adhesion to the plastic layer. Taking the penetrability of the coating composition into consideration, it is preferred for the molded article to have a Cobb's water absorptiveness (JIS P8140) of 5 to 600 g/($m^2$·2 min), particularly 10 to 200 g/($m^2$·2 min).

The coating composition is applied by spraying with a prescribed spraying means after the wet pulp deposited body 5 obtained in FIG. 4(*b*) is preliminarily dried to a prescribed water content, e.g., about 0.1 to 25% by weight. The void of the molded article being within the above range, the coating composition hardly penetrates into the molded article. As a result, most of the coating composition remains on the surface of the molded article, succeeding in manifesting sufficient waterproofness and water vapor proofness with a smaller amount of the coating composition than conventionally required. In addition, reduction in disintegrability of the pulp fiber in recycling is avoided. In using an emulsion as a coating composition, it is desirable to use an emulsion having a resin particle size of about 0.01 to 10 μm for controlling penetration of the emulsion into the molded article.

Yet another embodiment for forming a plastic layer on the outer surface of the molded article 10 comprises covering the outer surface of the molded article 10 with a shrink film with or without prescribed letters, figures, symbols, etc. printed thereon. The shrink film covers the entire outer surface of the molded article 10 so that penetration of water or oxygen from the outside into the inside can be prevented thereby to prevent reduction in paper strength of the molded article 10 and to prevent mold development in the contents. Further, reduction in quality of the contents due to penetration of water or oxygen can also be prevented. Furthermore, the strength of the molded article 10 is further enhanced, and the contents are effectively prevented from leaking.

Figure 25:
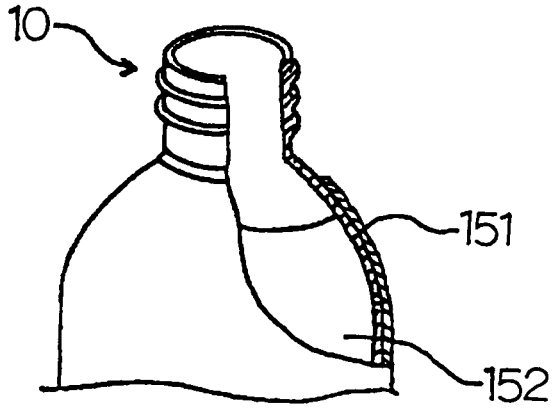
FIG. 25 is a partial perspective of a molded article covered with a shrink film, with part cut away.

According to the kind of the contents, the shrink film does not need to cover the entire outer surface of the molded article 10 as shown in FIG. 25. The embodiment shown in FIG. 25 is especially effective where the contents are such that generate gas on moisture absorption and the like. The shrink film 151 covers not all the outer surface of the molded article 10 but the area up to the height of or above the upper level of contents 152 and below the top of the container (the space between the upper level of the contents 152 and the top of the container is called a head space). In case when the contents react due to moisture absorption, etc. to generate gas, and the gas is accumulated in the head space, the gas has its escape blocked if the outer surface around the head space is covered with the shrink film 151. It follows that the molded article 10 is inflated and deformed, which makes the molded article 10 instable and, in the worst case, ends in a burst. According to the wrapping mode shown in FIG. 25, such a phenomenon does not occur because the generated gas is allowed to escape outside through the wall around the head space of the molded article 10.

The wrapping mode of FIG. 25 also has a merit that the shrink film can be saved. It may be conceivable that water or oxygen can enter through the wall around the head space of the molded article 10. Even if it happens, the contact of water or oxygen with the contents is indirect as mediated by the head space. This indirect contact of water or oxygen is far slower than the direct content of water or oxygen with the contents through the wall of the molded article 10 in view of material transfer. Accordingly only if the molded article 10 is wrapped up to the height of the contents, i.e., only if the direct contact through the wall of the molded article 10 is avoided, penetration of water or oxygen through the wall around the head space of the molded article 10 is not so problematical.

The shrink film 151 comprises a film of an olefin resin, a polyester resin, etc. For example, polyethylene terephthalate (PET), oriented polystyrene (OPS), etc. are useful as a material having good low-temperature shrinkability and high stiffness. For shrink packaging a product all over (overwrapping), polypropylene (PP), polyethylene (PE), etc. are useful as a thin and well-stretchable material. The above-described materials of shrink films comprise a uniaxially or biaxially stretched film having a single-layer or multilayer structure. Taking shrink finish, dimensional stability, and strength into consideration, it is desirable to choose a material having a heat shrinkage percentage (JIS Z1709) of 40% or more, a spontaneous shrinkage percentage (40%, 7 days) of 2% or less, a tensile strength of $20\times10^6$ Pa or more in the direction of shrinkage, and an elongation of 50% or more. The thickness of the shrink film 151, which is appropriately selected according to the use of the molded article 10 covered with the shrink film 151, the wall thickness of the molded article 10, the kind of the contents, and the like, is usually 10 to 150 μm, particularly 30 to 70 μm.

The molded article 10 having the outer surface thereof covered with the shrink film has an oxygen permeability of 500 $cm^3$/($m^2$·hr·atm) or less, particularly 100 $cm^3$/($m^2$·hr·atm) or less. It prevents the inside thereof from getting into a peroxidized state thereby to prevent reduction or deterioration of the quality of the contents. The oxygen permeability is measured according to the method specified in JIS K7126.

The molded article having the outer surface thereof covered with a shrink film is preferably produced by surrounding the molded article having a water content of 5 to 35% by weight by the shrink film and applying microwaves to shrink the shrink film into intimate contact with the molded article and, at the same time, to dry the molded article.

Figure 26:
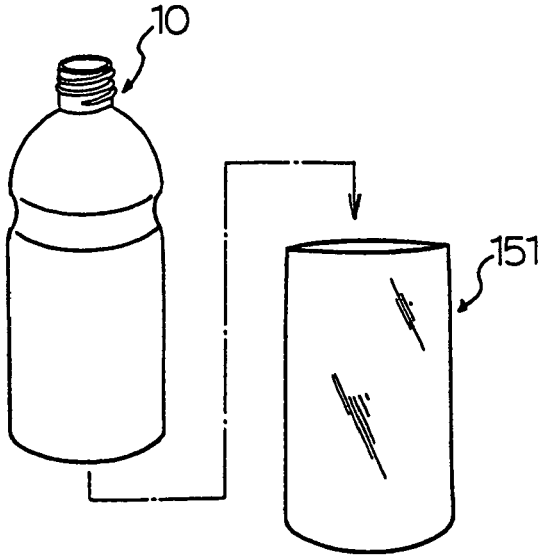
FIGS. 26(*a*) and 26(*b*) show the step of covering the outer surface of a molded article with a shrink film.
Figure 26:
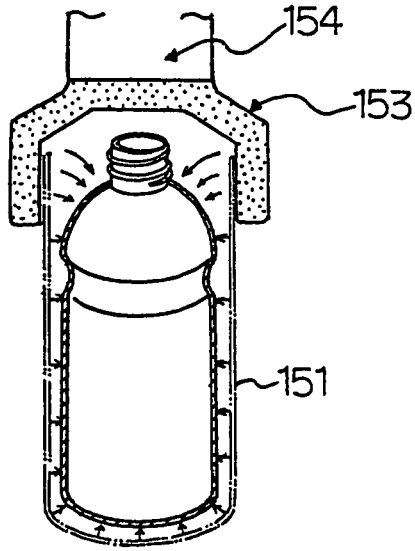

As shown in FIG. 26(*a*), the entire outer surface of a molded article 10 is surrounded by a shrink film 151. It is preferred to use the molded article 10 produced by the method of FIG. 4(*d*) which has a prescribed water content. The shrink film is prepared by making a sheet into a cylinder, sealing one end of the cylinder in the form of an arch (generally called R sealing), and cutting the other end. In this state, the gap between the body and the bottom portions and the shrink film is not so wide, while the gap between the opening portion and the shrink film is relatively wide.

An overcover 154 having a lid part 153 having a down-wall hanging from its periphery is put over both the opening portion of the molded article 10 and the upper part of the shrink film that surrounds the opening portion. The lid part 53 including the down-wall is capable of generating heat on irradiation with microwaves. The gap between the inner side of the down-wall and the shrink film is preferably as small as possible.

In this state, microwaves are applied, whereupon the water content of the molded article 10 is heated to generate heat, and the shrink film shrinks to tightly adhere to the molded article 10 by the generated heat. At the same time, the water content is removed from the molded article 10 to finally dry the molded article. In other words, this method can achieve the two steps—shrinking the shrink film 151 and finally drying the molded article—in a single operation of microwaves application.

On being irradiated with microwaves, not only the molded article 10 but the lid part 153 of the overcover 154 generate heat, with which the shrink film, particularly of the area around the opening portion of the molded article 10, shrinks to reduce the gap between the shrink film and the outer surface of the opening portion. Thus, the heat generated from the opening portion itself is added to the shrink film to accelerate the shrinkage of the shrink film. As a result, shrinkage around the opening portion that is not easy due to the diameter difference from the other portions can be achieved very easily. Additionally, the shrink film after shrinkage has improved appearance. Thus, shrink wrapping by the use of the overcover 154 is effective in case where the molded article has different diameters from its opening portion to the bottom portion. Where the opening portion has a smaller diameter than the body portion, it is particularly effective where the diameter of the opening portion is not more than 50% of that of the body portion.

As described above, the lid part 153 of the overcover 154 is capable of generating heat on microwaves application. The lid part 153 is preferably made of water-containing wood, paper, sponge or nonwoven fabric, etc., taking into consideration ease in shaping in conformity with the outer contour of a molded article, good heat generation efficiency, satisfactory properties of covering a shrink film, and satisfactory operating properties. The shape of the lid part 153 is not particularly limited as long as the shrink film around the opening portion of the molded article 10 can be surrounded thereby.

The wavelength of the microwaves applied is generally 300 MHz to 300 GHz. A wavelength providing the highest heat generation efficiency is selected appropriately.

The molded article 10 thus covered with the shrink film is then filled with the contents. Depending on the kind of the contents, filling the molded article 10 which is preliminarily dried with the contents may be followed by covering with the shrink film.

The present invention is not limited to the above-described embodiments, and various modifications can be made therein. The steps, apparatus, elements and the like used in each of the above-described embodiments are interchangeable with each other. While the second to eighth embodiments have been described as embodiments of the first aspect of the invention, they shall apply the second aspect. The molds used in the present invention can be composed of a set of two or three or more splits in accordance with the shape of articles to be molded. The same applies to the heating molds.

INDUSTRIAL APPLICABILITY

The present invention provides a molded article made mainly of pulp the side walls of which have a large angle to the ground and which has a large depth. The present invention also provides a molded article made mainly of pulp which involves no reduction in strength, has a satisfactory appearance, and has a depression or a projection of prescribed shape around its opening or body portions. These molded articles can be produced at a low cost. Besides, they can be recycled or incinerated after use, which leads to reduction of waste.

The invention claimed is:

1. A molded article made predominantly of pulp and comprising:

a bottom portion; and a body portion, wherein an angle between an outer surface of a side wall of said body portion and a ground contact plane of said bottom portion is 85° or greater, said molded article is seamless, a height of said body portion is 50 mm or more, and said molded article has corners of a density $\rho 2$ that is smaller than a density $\rho 1$ of a portion that is not one of said corners.

2. The molded article according to claim 1, wherein $\rho 1$ and $\rho 2$ satisfy a relationship $0.1\times\rho 1<\rho 2<\rho 1$.

3. The molded article according to claim 1, further comprising a lid for opening and closing said opening portion of said molded article and/or a measuring container, said lid and/or said measuring container being linked with said molded article by integral molding via a first hinge and/or a second hinge which is/are thin and dense.

4. The molded article according to claim 1, further comprising a lid for opening and closing said opening portion of said molded article, said lid being a part prepared separately from said molded article and fixed to said molded article by a linking part having a hinge, said linking part being provided on said lid.

5. The molded article according to claim 1, further comprising a plastic layer formed on the outer and/or the inner surfaces of said molded article by vacuum forming or pressure forming, and said plastic layer is obtainable by laminating a plastic film on said molded article while said molded article is heated to a predetermined temperature.

6. The molded article according to claim 5, wherein said plastic film is preliminarily stretched prior to lamination.

7. The molded article according to claim 1, wherein said molded article has corners of an approximately uniform thickness T2 that is greater than a thickness T1 of a portion that is not one of said corners, and said thickness T2 continuously tapers into said thickness T1.

* * * * *